US007984760B2

(12) United States Patent
Haeberle et al.

(10) Patent No.: US 7,984,760 B2
(45) Date of Patent: Jul. 26, 2011

(54) WELLBORE METHOD AND APPARATUS FOR SAND AND INFLOW CONTROL DURING WELL OPERATIONS

(75) Inventors: David C. Haeberle, Cypress, TX (US); Charles Yeh, Spring, TX (US); Timothy G. Benish, Pearland, TX (US); Michael D. Barry, The Woodlands, TX (US); Michael T. Hecker, Tomball, TX (US); Jon Blacklock, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 89 days.

(21) Appl. No.: 12/279,176

(22) PCT Filed: Feb. 23, 2007

(86) PCT No.: PCT/US2007/004770

§ 371 (c)(1),
(2), (4) Date: Aug. 12, 2008

(87) PCT Pub. No.: WO2007/126496

PCT Pub. Date: Nov. 8, 2007

(65) Prior Publication Data

US 2009/0008092 A1 Jan. 8, 2009

Related U.S. Application Data

(60) Provisional application No. 60/788,795, filed on Apr. 3, 2006.

(51) Int. Cl.
*E21B 43/04* (2006.01)
*E21B 43/08* (2006.01)

(52) U.S. Cl. ..... 166/278; 166/236

(58) Field of Classification Search ..... 166/278, 166/51, 228, 236

See application file for complete search history.

(56) References Cited

U.S. PATENT DOCUMENTS 4,888,120 A 12/1989 Mueller et al.

(Continued)

FOREIGN PATENT DOCUMENTS

GB 2 343 469 A 5/2000

(Continued)

OTHER PUBLICATIONS

Baker Oil Tools, Equalizer™ Production Management System, brochure from Baker Hughes Incorporated, 1999, BGP-3-99017-5M-04/99, 2 pages.

(Continued)

*Primary Examiner* — Daniel P Stephenson

(57) ABSTRACT

A method, system and apparatus associated with the production of hydrocarbons are described. The system includes a wellbore that accesses a subsurface reservoir; a production tubing string disposed within the wellbore; and one or more sand control devices coupled to the production tubing string and disposed within the wellbore. At least one of the sand control devices includes a first tubular member having a permeable section and a non permeable section; a second tubular member disposed within the first tubular member. The second tubular member has a plurality of openings and an inflow control device that each provide a flow path to the interior of the second tubular member. Also, the at least one of the sand control devices includes a sealing mechanism disposed between the first tubular member and the second tubular member. The sealing mechanism is configured to provide a pressure loss during gravel packing operations that is less than the pressure loss during at least some of the production operations.

74 Claims, 17 Drawing Sheets

U.S. PATENT DOCUMENTS 4,945,991 A 8/1990 Jones
5,082,052 A 1/1992 Jones et al.
5,113,935 A 5/1992 Jones et al.
5,293,935 A 3/1994 Arterbury et al.
5,333,688 A 8/1994 Jones et al.
5,435,393 A 7/1995 Brekke et al.
5,476,143 A 12/1995 Sparlin et al.
5,515,915 A 5/1996 Jones et al.
5,642,781 A 7/1997 Richard
5,803,179 A 9/1998 Echols et al.
5,890,533 A 4/1999 Jones
5,896,928 A 4/1999 Coon
5,909,774 A 6/1999 Griffith et al.
6,112,815 A 9/2000 Boe et al.
6,112,817 A 9/2000 Voll et al.
6,220,345 B1 4/2001 Jones et al.
6,227,303 B1 5/2001 Jones
6,237,683 B1 5/2001 Pringle et al.
6,302,216 B1 10/2001 Patel
6,308,783 B2 10/2001 Pringle et al.
6,382,319 B1 5/2002 Hill, Jr. et al.
6,405,800 B1 6/2002 Walker et al.
6,446,729 B1 9/2002 Bixenman et al.
6,464,261 B1 10/2002 Dybevik et al.
6,505,682 B2 * 1/2003 Brockman ..... 166/250.15
6,513,599 B1 2/2003 Bixenman et al.
6,533,038 B2 3/2003 Venning et al.
6,581,689 B2 6/2003 Hailey, Jr.
6,601,646 B2 8/2003 Streich et al.
6,622,794 B2 9/2003 Zisk, Jr.
6,644,412 B2 11/2003 Bode et al.
6,679,324 B2 * 1/2004 Den Boer et al. ..... 166/66.6
6,715,558 B2 4/2004 Williamson
6,745,843 B2 6/2004 Johnson et al.
6,749,024 B2 6/2004 Bixenman
6,752,206 B2 6/2004 Watson et al.
6,786,285 B2 9/2004 Johnson et al.
6,789,623 B2 9/2004 Hill, Jr. et al.
6,814,144 B2 11/2004 Jones
6,817,410 B2 11/2004 Wetzel et al.
6,817,416 B2 11/2004 Wilson et al.
6,830,104 B2 12/2004 Nguyen et al.
6,851,560 B2 2/2005 Reig et al.
6,857,475 B2 2/2005 Johnson
6,860,330 B2 3/2005 Jackson
6,868,910 B2 3/2005 Corre et al.
6,875,476 B2 4/2005 Hawtin et al.
6,883,613 B2 4/2005 Bode et al.
6,886,634 B2 5/2005 Richards
6,892,816 B2 5/2005 Pringle et al.
6,899,176 B2 5/2005 Hailey, Jr. et al.
6,935,432 B2 8/2005 Nguyen
6,978,840 B2 12/2005 Henderson
6,983,796 B2 1/2006 Bayne et al.
6,997,263 B2 2/2006 Campbell et al.
7,055,598 B2 * 6/2006 Ross et al. ..... 166/236
7,096,945 B2 * 8/2006 Richards et al. ..... 166/276
7,100,691 B2 9/2006 Nguyen et al.
7,185,706 B2 * 3/2007 Freyer ..... 166/369
7,234,518 B2 6/2007 Smith
7,252,142 B2 8/2007 Brezinski et al.
7,264,061 B2 9/2007 Dybevik et al.
7,367,395 B2 5/2008 Vidrine et al.
7,407,007 B2 8/2008 Tibbles
7,413,022 B2 * 8/2008 Broome et al. ..... 166/386
7,431,085 B2 10/2008 Coronado et al.
7,431,098 B2 10/2008 Ohmer et al.
7,441,605 B2 10/2008 Coronado et al.
7,469,743 B2 * 12/2008 Richards ..... 166/242.1
7,591,321 B2 9/2009 Whitsitt et al.
7,644,758 B2 * 1/2010 Coronado et al. ..... 166/205
7,708,068 B2 * 5/2010 Hailey, Jr. ..... 166/278
2002/0104650 A1 8/2002 Dusterhoft et al.
2003/0070809 A1 4/2003 Schultz et al.
2003/0089495 A1 * 5/2003 Bixenman ..... 166/265
2003/0173075 A1 9/2003 Morvant et al.
2004/0007829 A1 1/2004 Ross
2004/0020832 A1 * 2/2004 Richards et al. ..... 210/106
2004/0035591 A1 2/2004 Echols
2004/0134656 A1 * 7/2004 Richards ..... 166/276
2004/0140089 A1 7/2004 Gunneroed
2004/0144544 A1 * 7/2004 Freyer ..... 166/369
2004/0251020 A1 12/2004 Smith
2004/0262011 A1 12/2004 Huckabee et al.
2005/0028977 A1 2/2005 Ward
2005/0061501 A1 3/2005 Ward et al.
2005/0082060 A1 4/2005 Ward et al.
2005/0263287 A1 12/2005 Achee, Jr. et al.
2006/0042795 A1 3/2006 Richards
2006/0060352 A1 3/2006 Vidrine et al.
2006/0113089 A1 * 6/2006 Henriksen et al. ..... 166/386
2006/0157257 A1 * 7/2006 Ross et al. ..... 166/386
2006/0237197 A1 10/2006 Dale et al.
2007/0056750 A1 3/2007 John et al.
2008/0041580 A1 * 2/2008 Freyer et al. ..... 166/193
2009/0151925 A1 * 6/2009 Richards et al. ..... 166/53
2009/0283279 A1 11/2009 Patel et al.
2009/0294128 A1 12/2009 Dale et al.

FOREIGN PATENT DOCUMENTS

WO WO 2007/092082 A2 8/2007

OTHER PUBLICATIONS

Baker Oil Tools, "Equalizer™ Production Enhancement System, maximize hydrocarbon recovery with this simple and reliable tool", brochure from Baker Hughes Incorporated, 2005, BOT-04-7761-4M-0605, 6 pages.

Reslink, "ResFlow™ Well Production Management System", brochure from Reslink, 2005, Version 02.05, pp. 1-4.

Weatherford International Ltd., "Application Answers; Combating Coning by Creating Even Flow Distribution in Horizontal Sand-Control Completions", brochure from Weatherford International Ltd., 2005, doc. 2980.00, 4 pages.

International Search Report and Written Opinion mailed Mar. 6, 2008, 6 pages.

* cited by examiner

WELLBORE METHOD AND APPARATUS FOR SAND AND INFLOW CONTROL DURING WELL OPERATIONS

CROSS REFERENCE TO RELATED APPLICATIONS

This application is the National Stage of International Application No. PCT/US07/04770, filed 23 Feb. 2007, which claims the benefit of U.S. Provisional Application No. 60/788,795, filed 3 Apr. 2006.

FIELD OF THE INVENTION

This invention relates generally to an apparatus and method for use in wellbores and associated with the production of hydrocarbons. More particularly, this invention relates to a wellbore apparatus and method for providing flow control that may be utilized to enhance at least gravel packing and production operations for a well.

BACKGROUND

This section is intended to introduce various aspects of the art, which may be associated with exemplary embodiments of the present invention. This discussion is believed to assist in providing a framework to facilitate a better understanding of particular aspects of the present invention. Accordingly, it should be understood that this section should be read in this light, and not necessarily as admissions of prior art.

The production of hydrocarbons, such as oil and gas, has been performed for numerous years. However, when producing hydrocarbons from subsurface or subsurface formations, it becomes more challenging because of the location of certain subsurface formations. For example, some subsurface formations are located in ultra-deep water, at depths that extend the reach of drilling operations, in high pressure/temperature reservoirs, in long intervals, at high production rate, and at remote locations. As such, the location of the subsurface formation may present problems that increase the individual well cost dramatically. That is, the cost of accessing the subsurface formation may result in fewer wells being completed because of the economics of the field. Accordingly, well reliability and longevity become design considerations to avoid undesired production loss and expensive intervention or workovers for these wells.

To enhance hydrocarbon production, a production system may utilize various devices, such as sand control devices and other tools, for specific tasks within a well. Typically, these devices are placed into a wellbore completed in either a cased-hole or open-hole completion. In a cased-hole completion, a casing string is placed in the wellbore and perforations are made through the casing string into subsurface formations to provide a flow path for formation fluids, such as hydrocarbons, into the wellbore. Alternatively, in an open-hole completion, a production string is positioned inside the wellbore without a casing string. The formation fluids flow through the annulus between the subsurface formation and the production string to enter the production string.

Regardless of the completion type, sand control devices are typically utilized within a well to manage the production of solid material, such as sand. The production of solid material may result in sand production at surface, downhole equipment damage, reduced well productivity and/or loss of the well. The sand control device, which may have slotted openings or may be wrapped by a screen, may also be utilized with a gravel pack in certain environments. Gravel packing a well involves placing gravel or other particulate matter around a sand control device. In an open-hole completion, a gravel pack is typically positioned between the wall of the wellbore and a sand screen that surrounds a perforated base pipe. Alternatively, in a cased-hole completion, a gravel pack is positioned between a casing string having perforations and a sand screen that surrounds a perforated base pipe. Regardless, the formation fluids flow from the subsurface formation into the production tubing string through the gravel pack and sand control device, while solids above a certain size are blocked.

As an enhancement to the gravel packing process, alternative technologies may also be utilized to form substantially complete gravel packs within the wellbore. For example, the alternate flow paths, such as internal or external shunt tubes, may be utilized to bypass sand bridges and distribute the gravel evenly through the intervals. For further details, alternate flow paths are described further in U.S. Pat. Nos. 4,945,991; 5,082,052; 5,113,935; 5,333,688 and Intl. Patent Appl. No. PCT/US04/01599; which are incorporated herein by reference.

In addition to preventing solids production, the flow of the formation fluids may also be controlled within a well. For instance, sand control devices may include technology to regulate flow downhole, such as inflow control technology or inflow control devices (ICDs). See, e.g., Reslink's RES-FLOW™, Baker's EQUALIZER™, or Weatherford's FLO-REG™. These devices are typically used in long, horizontal, open-hole completions to balance inflow into the completion across production intervals or zones. The balanced inflow enhances reservoir management and reduces the risk of early water or gas breakthrough from a high permeability reservoir streak or the heel of a well. Additionally, more hydrocarbons may be captured from the toe of the well through the application of the inflow control technology.

Because gravel packing operations generally involve passing large quantities of fluid, such as carrier fluid, through the sand screen and the ICD, gravel packing with typical ICDs is not feasible because the gravel packing and production operations use the same flow paths. In particular, localized and reduced inflow of the carrier fluid due to ICDs may cause early bridging, loose packs, voids, and/or increased pressure requirements during gravel pack pumping. Accordingly, the need exists for method and apparatus that provides inflow control without limiting the formation of a gravel pack.

Other related material may be found in at least U.S. Pat. Nos. 5,293,935; 5,435,393; 5,642,781; 5,803,179; 5,896,928; 6,112,815; 6,112,817; 6,237,683; 6,302,216; 6,308,783; 6,405,800; 6,464,261; 6,533,038; 6,622,794; 6,644,412; 6,715,558; 6,745,843; 6,749,024; 6,786,285; 6,817,416; 6,851,560; 6,857,475; 6,875,476; 6,860,330; 6,868,910; 6,883,613; 6,886,634; 6,892,816; 6,899,176; 6,978,840; Application Publication No. 2003/0173075; U.S. Patent Application Publication No. 2004/0251020; U.S. Patent Application Publication No. 2004/0262011; U.S. Patent Application Publication No. 2005/0263287; U.S. Patent Application Publication No. 2006/0042795; U.S. Patent App. No. 60/765,023; and U.S. Patent App. No. 60/775,434.

SUMMARY

In one embodiment, a system associated with production of hydrocarbons is described. The system includes a wellbore utilized to produce hydrocarbons from a subsurface reservoir; a production tubing string disposed within the wellbore; and at least one sand control device coupled to the production tubing string and disposed within the wellbore. At least one of the at least one sand control device includes a first tubular member having a permeable section and a non permeable section; a second tubular member disposed within the first tubular member, wherein the second tubular member has a plurality of openings and at least one inflow control device that each provide a flow path to the interior of the second tubular member; and a sealing mechanism disposed between the first tubular member and the second tubular member, wherein the sealing mechanism is configured to provide pressure loss during gravel packing operations that is less than the pressure loss during at least a portion of production operations.

In a second embodiment, a method of producing hydrocarbons from a well is described. The method includes disposing at least one sand control device within a wellbore adjacent to a subsurface formation, wherein at least one of the at least one sand control device comprises a first tubular member having a permeable section and a non permeable section; a second tubular member disposed within the first tubular member, wherein the second tubular member has a plurality of openings and at least one inflow control device that each provide a flow path to the interior of the second tubular member; and a sealing mechanism disposed between the first tubular member and the second tubular member, wherein the sealing mechanism is configured to provide pressure loss during gravel packing operations that is less than the pressure loss during at least a portion of production operations; gravel packing the at least one sand control device within the wellbore; and producing hydrocarbons from the at least one sand control device by passing hydrocarbons through the at least one sand control device.

In a third embodiment, another system associated with production of hydrocarbons is described. This system includes a production tubing string disposed within a wellbore utilized to access a subsurface formation; at least one sand control device coupled to the production tubing string and disposed within the wellbore. At least one of the at least one sand control device includes a first tubular member having a permeable section and a non permeable section; a second tubular member disposed within the first tubular member, wherein the second tubular member has a plurality of openings and at least one inflow control device; and a sealing mechanism disposed between the first tubular member and the second tubular member. The sealing mechanism configured to provide a first flow path into the interior of the second tubular member during gravel packing operations through one of only the plurality of openings and the plurality of openings along with the at least one inflow control device and provide a second flow path into the interior of the second tubular member during a portion of production operations through only the at least one inflow control device.

In a fourth embodiment, another method associated with production of hydrocarbons is described. The method includes providing a sand control device having a first tubular member with a permeable section and a non permeable section; a second tubular member disposed within the first tubular member, wherein the second tubular member has a plurality of openings and at least one inflow control device; and a sealing mechanism disposed between the first tubular member and the second tubular member, wherein the sealing mechanism is configured to provide a first flow path to the interior of the second tubular member during gravel packing operations through one of only the plurality of openings and the plurality of openings along with the at least one inflow control device; and provide a second flow path to the interior of the second tubular member during at least a portion of production operations through only the at least one inflow control device; disposing the sand control device within a wellbore; engaging the sand control device to a crossover tool to form a gravel pack at least partially around the sand control device; disengaging the crossover tool from the sand control device; and coupling the sand control device to a production tubing string to produce hydrocarbons through the at least one inflow control device.

In a fifth embodiment, an apparatus for producing hydrocarbons is described. The apparatus includes a first tubular member having a permeable section and a non permeable section; a second tubular member disposed within the first tubular member, wherein the second tubular member has a plurality of openings and at least one inflow control device; and a sealing element disposed between the first tubular member and the second tubular member and disposed between the plurality of openings and at least one inflow control device. The sealing element is configured to provide a first flow path into the interior of the second tubular member from the permeable section of the first tubular member through the plurality of openings and a second flow path into the interior of the second tubular member from the permeable section of the first tubular member through the at least one inflow control device during a first operation; and block fluid flow through the first flow path during a second operation.

In a sixth embodiment, a second apparatus for producing hydrocarbons is described. The apparatus includes a first tubular member having a permeable section and a non permeable section; a second tubular member disposed within the first tubular member, wherein the second tubular member has a plurality of openings that provide a fluid flow path into the interior of the second tubular member; and a barrier element disposed between the first tubular member and the second tubular member. The barrier element being configured to isolate a first chamber from a second chamber formed between the first tubular member and second tubular member, wherein the first chamber includes the permeable section of the first tubular member and the second chamber includes the plurality of openings in the second tubular member; and at least one conduit disposed between the first tubular member and second tubular member, wherein the at least one conduit provides at least one fluid flow path between the first chamber and the second chamber through the barrier element.

In a seventh embodiment, a third apparatus for producing hydrocarbons is described. The apparatus includes a first tubular member having a permeable section and a non permeable section; a second tubular member disposed within the first tubular member, wherein the second tubular member has a plurality of openings and at least one inflow control device; and a sleeve disposed adjacent to the second tubular member and configured to move between a plurality of positions. The plurality of positions include a first position providing a first flow path into the interior of the second tubular member from the permeable section of the first tubular member through at least the plurality of openings; and a second position providing a second flow path into the interior of the second tubular member from the permeable section of the first tubular member through the at least one inflow control device, wherein fluid flow is prevented through the plurality of openings.

BRIEF DESCRIPTION OF THE DRAWINGS

The foregoing and other advantages of the present invention may become apparent upon reviewing the following detailed description and drawings of non-limiting examples of embodiments in which.

DETAILED DESCRIPTION

In the following detailed description section, the specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

The present invention includes one or more embodiments of sand control devices that may be utilized in a completion, production, or injection system to enhance well operations, which may include gravel packing operations and production operations, which are described below. Under the present invention, an apparatus, system and method are described for running and gravel packing a sand control device having an inflow control mechanism in a well completion, such as an open-hole or cased-hole completion. Then, the sand control device is utilized to produce formation fluids, such as hydrocarbons, from the well completion. The embodiments of the sand control device may include a sand control device with a sealing mechanism, such as a swellable material, sealing element or adjustable sleeve. Accordingly, the specific embodiments of the sand control device may include a sand control device with a sealing element, at least one conduit, and/or at least one sleeve to provide flexibility in the well operations. In this embodiment, the sealing mechanism is configured to provide pressure loss during certain operations, such as gravel packing operations, that is less than the pressure loss during other operations, such as production operations. The pressure loss is change in fluid pressure as the fluid flows outside the sand control device into the interior of the base pipe or primary tubular member. The pressure loss may include frictional pressure loss and form loss. The higher pressure loss results in increased inflow control, which provides flexibility in providing the desired fluid flow control for the different operations. As such, the present invention may be used in well completions to enhance gravel placement, hydrocarbon production and/or stimulation of a subsurface formation. Note that in a well completion, the sand control devices of the present invention may be used in combination with other sand control devices.

Figure 1:
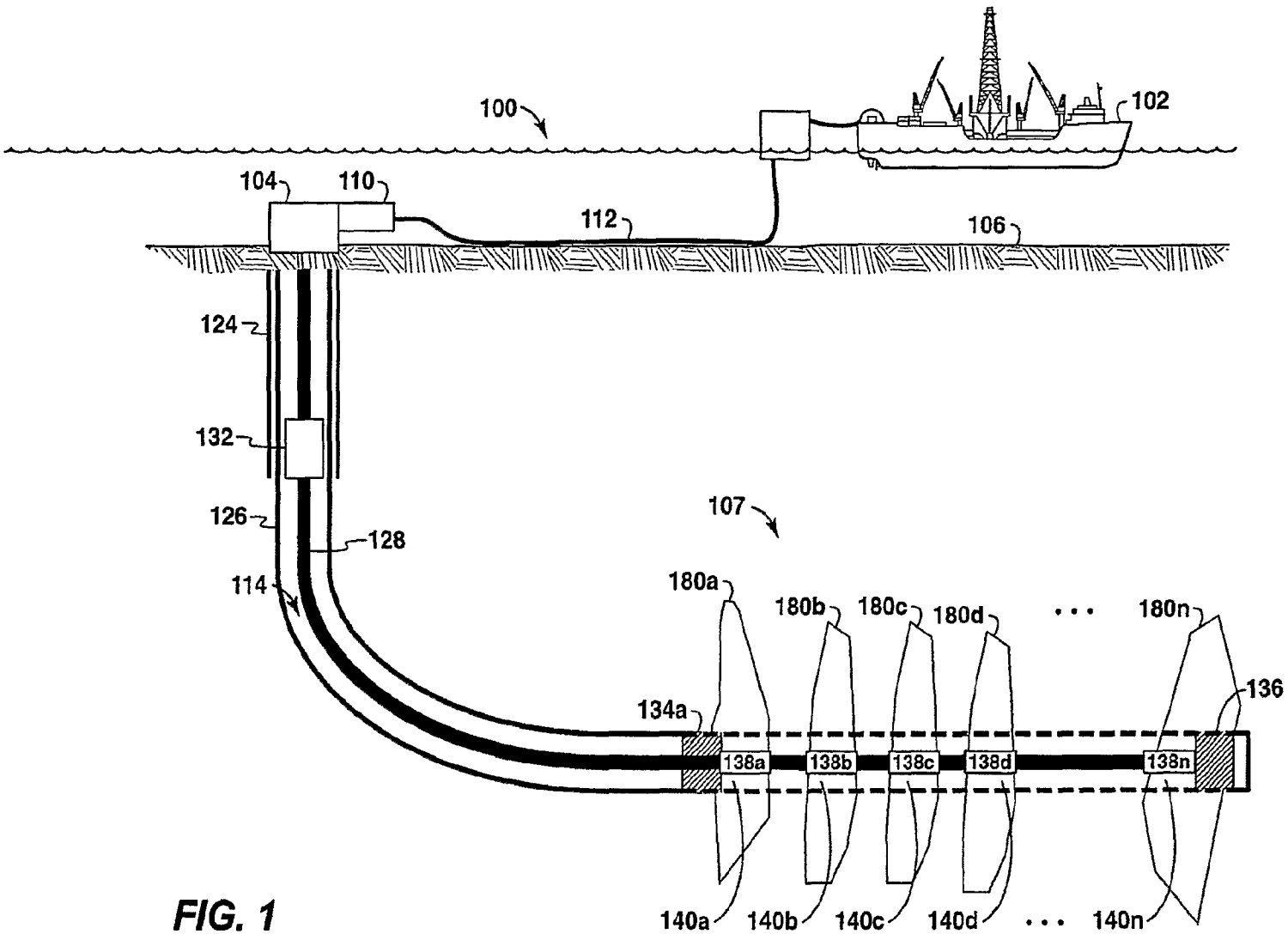
FIG. 1 is an exemplary production system in accordance with certain aspects of the present invention.

Turning now to the drawings, and referring initially to FIG. 1, an exemplary production system 100 in accordance with certain aspects of the present invention is illustrated. In the exemplary production system 100, a floating production facility 102 is coupled to a subsea tree 104 located on the sea floor 106. Through this subsea tree 104, the floating production facility 102 accesses one or more subsurface formations, such as subsurface formation 107, which may include multiple production intervals or zones 108*a*-108n, wherein number "n" is any integer number. The production intervals 108*a*-108n may have hydrocarbons, such as oil and gas. Beneficially, devices, such as sand control devices 138*a*-138n having inflow control mechanisms, may be utilized to enhance the production of hydrocarbons from the production intervals 108*a*-108n. However, it should be noted that the production system 100 is illustrated for exemplary purposes and the present invention may be useful in the production or injection of fluids from any subsea, platform or land location.

The floating production facility 102 may be configured to monitor and produce hydrocarbons from the production intervals 108*a*-108n of the subsurface formation 107. The floating production facility 102 may be a floating vessel capable of managing the production of fluids, such as hydrocarbons, from subsea wells. These fluids may be stored on the floating production facility 102 and/or provided to tankers (not shown). To access the production intervals 108*a*-108n, the floating production facility 102 is coupled to a subsea tree 104 and control valve 110 via a control umbilical 112. The control umbilical 112 may include production tubing for providing hydrocarbons from the subsea tree 104 to the floating production facility 102, control tubing for hydraulic or electrical devices, and a control cable for communicating with other devices within the wellbore 114.

To access the production intervals 108*a*-108n, the wellbore 114 penetrates the sea floor 106 to a depth that interfaces with the production intervals 108*a*-108n at different depths within the wellbore 114. As may be appreciated, the production intervals 108*a*-108n, which may be referred to as production intervals 108, may include various layers or intervals of rock that may or may not include hydrocarbons and may be referred to as zones. The subsea tree 104, which is positioned over the wellbore 114 at the sea floor 106, provides an interface between devices within the wellbore 114 and the floating production facility 102. Accordingly, the subsea tree 104 may be coupled to a production tubing string 128 to provide fluid flow paths and a control cable (not shown) to provide communication paths, which may interface with the control umbilical 112 at the subsea tree 104.

Within the wellbore 114, the production system 100 may also include different equipment to provide access to the production intervals 108*a*-108n. For instance, a surface casing string 124 may be installed from the sea floor 106 to a location at a specific depth beneath the sea floor 106. Within the surface casing string 124, an intermediate or production casing string 126, which may extend down to a depth near the production interval 108*a*, may be utilized to provide support for walls of the wellbore 114. The surface and production casing strings 124 and 126 may be cemented into a fixed position within the wellbore 114 to further stabilize the wellbore 114. Within the surface and production casing strings 124 and 126, a production tubing string 128 may be utilized to provide a flow path through the wellbore 114 for hydrocarbons and other fluids. A subsurface safety valve 132 may be utilized to block the flow of fluids from portions of the production tubing string 128 in the event of rupture or break above the subsurface safety valve 132. Further, packers 134 and 136 may be utilized to isolate specific zones within the wellbore annulus from each other. The packers 134 and 136 may be configured to provide fluid communication paths between surface and the sand control devices 138*a*-138n, while preventing fluid flow in one or more other areas, such as a wellbore annulus.

In addition to the above equipment, other equipment, such as sand control devices 138*a*-138n and gravel packs 140*a*-140n, may be utilized to manage the flow of fluids from within the wellbore. In particular, the sand control devices 138*a*-138n may be utilized to manage the flow of fluids and/or particles into the production tubing string 128 with gravel packs 140*a*-140n. The sand control devices 138*a*-138n may include slotted liners, stand-alone screens (SAS); pre-packed screens; wire-wrapped screens, membrane screens, expandable screens and/or wire-mesh screens, while the gravel packs 140*a*-140n may include gravel or other suitable solid material. The sand control devices 138*a*-138n may also include inflow control mechanisms, such as inflow control devices (i.e. valves, conduits, nozzles, or any other suitable mechanisms), which may increase pressure loss along the fluid flow path. The gravel packs 140*a*-140n may be complete gravel packs that cover all of the respective sand control devices 138*a*-138n, or may be partially disposed around sand control devices 138*a*-138n. Regardless, the sand control devices 138*a*-138n may include different components that provide flow control for the intervals 108*a*-108n of the well. The process of installing and using these sand control devices is shown below in FIG. 2.

Figure 2:
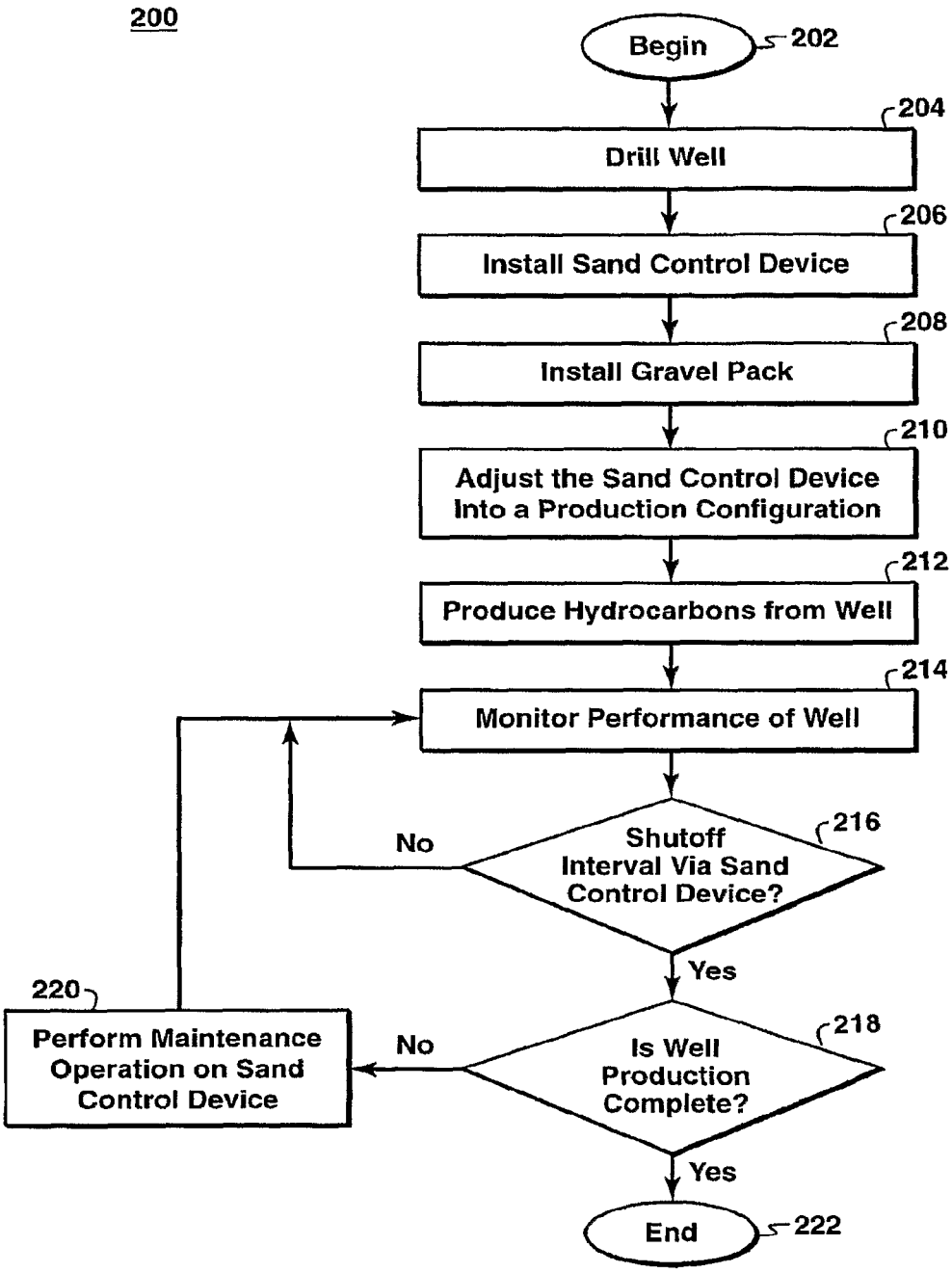
FIG. 2 is an exemplary flow chart of well operations involving a sand control device with an inflow control mechanism in FIG. 1 in accordance with aspects of the present invention.

FIG. 2 is an exemplary flow chart of the installation and use of the sand control devices of FIG. 1 in accordance with aspects of the present invention. This flow chart, which is referred to by reference numeral 200, may be best understood by concurrently viewing FIG. 1. In this flow chart 200, a process to enhance the production of hydrocarbons from a wellbore 114 by providing flow control in a sand control device along with gravel packs is described. That is, the present technique provides a mechanism for efficiently forming a gravel pack around a sand control device and providing flow control for fluids produced from the intervals once the gravel pack is formed. Accordingly, the sand control device may enhance operations and production of hydrocarbons from intervals 108 of the subsurface formation 107.

The flow chart begins at block 202. At block 204, a well may be drilled. The well may be drilled to a specific depth location through various production intervals 108 of the subsurface formation 107. The drilling of the well may involve drilling operations and typical techniques utilized for the specific fields. Then, gravel packing operations may be performed in blocks 206 and 208. The gravel packing operations include installing one or more sand control devices having an inflow control mechanism into the well, as shown in block 206. The sand control devices may include various embodiments, such as sand control device having a inflow control mechanism with a sealing element (shown in FIGS. 3A-3G, 4A-4G, 5A-5F, 6A-6G and 7A-7B), sand control device having an inflow control mechanism being conduits (shown in FIGS. 8A-8C, 9A-9E and 10A-10C), and sand control device having an inflow control mechanism with a sleeve (shown in FIGS. 11A-11F). Each of these embodiments may be installed using various techniques, such as by a drilling string, wireline, and coil tubing, and other similar techniques known to those skilled in the art. At block 208, a gravel pack may be installed within the wellbore around the sand control device. The installation of the gravel pack may include coupling a crossover tool to the sand control device and pumping carrier fluid with gravel through the crossover tool. Through the engagement between the sand control device and the crossover tool, a gravel pack may be formed at least partially around the sand control device. A specific process for forming the gravel pack is discussed further in U.S. Provisional Application No. 60/778,434. However, it should be noted that gravel packing operations may include other alternate path gravel packing or alpha beta gravel packing techniques and procedures, as well.

Once the gravel packing operations are complete, production operations may be performed in blocks 210-220. With the sand control device and gravel pack installed, the sand control device may be adjusted into a production configuration, as shown in block 210. This adjustment may include removing a washpipe, sending a signal via electrical cable or hydraulics to activate a sleeve, chemical activation or other suitable techniques to adjust the sand control device for production operations. In particular, it should be noted that the adjustment to the sand control device may be activated automatically by the presence of a stimulus, which is discussed further below. At block 212, hydrocarbons, such as oil and gas, may be produced from the well. The production of hydrocarbons may include disengaging the crossover tool from the sand control device and coupling the sand control device to a production tubing string to produce hydrocarbons through at least one of the inflow control devices. During production, the performance of the well may be monitored, as shown in block 214. The monitoring of the well may include general surveillance, such as monitoring the hydrocarbon production rate, water cut, gas to oil ratio, production profile from production logging, sand production and/or other similar techniques. Also, the monitoring may include detectors and sensors that determine the levels of sand production, down hole pressure, downhole temperature profiles and the like. At block 216, a determination is made whether to shutoff fluid flow into the sand control device. This determination may include comparing the production from a certain interval to a predetermined threshold, or indication from a monitor within the wellbore that excessive water production is from a certain interval, such as a toe interval. If the interval does not need to be shutoff, the well monitoring may continue in block 214.

However, if the interval is shutoff, a determination is made whether the production operations are to continue, as shown in block 218. If the production operations are to continue, a maintenance operation may be performed in block 220. The maintenance operation may include activating a mechanism within the inflow control device, such as a sleeve or valve, to prevent fluid flow into the sand control device; installing a straddle bridge across the specific interval; treating the interval with a treatment fluid and/or installing a plug within or upstream of the sand control device. Then, monitoring of the well continues in block 214. Regardless, if the well production is complete, then the process may end at block 222.

Beneficially, the use of the sand control device provides a mechanism for enhancing gravel packing operations and flexibility in the production operations, such as maintenance operations. The sand control device provides a mechanism for gravel packing a well with various perforations that may or may not be utilized in the production of hydrocarbons. Also, the sand control device may be shutoff to prevent formation fluids from entering the wellbore from a specific interval to manage specific portions of the wellbore. That is, the sand control devices provide flexibility in isolating and managing the flow from various intervals from unwanted gas or water production. These sand control devices also provide flexibility for installations to regulate flow between formations of varying pressure, productivity or permeability. For instance, the same type of sand control device may be used within a well with one interval being gravel packed and others are not gravel packed. That is, the sand control device may be utilized to gravel pack specific intervals, while other intervals are not gravel packed as part of the same process. Further, by providing balanced inflow, the sand control devices may limit annular flow to prevent hot-spots in the completion at a location of high inflow, which is typically at the heel of the completion or at an external isolation packer. Hot-spots are locations of high velocity flow where erosion is likely if sand particles or fines are in the flow stream.

For exemplary purposes, various sand control devices 138*a*-138n are herein described in various embodiments below. In these embodiments, a sealing mechanism may include a sealing element, a barrier element, and/or sleeve in the respective embodiments. Also, the inflow control mechanism may include a conduit or inflow control devices (i.e. small orifice or choke) in the respective embodiments. Accordingly, the specific features of each of the embodiments is discussed in the FIGS. 3A-3G, 4A-4G, 5A-5F, 6A-6G, 7A-7C, 8A-8C, 9A-9F, 10A-10F, 11A-11F and 12.

Sand Control Device with Sealing Element

FIGS. 3A-3G are illustrative views of an embodiment of a sand control device utilized in the production system of FIG. 1 having an inflow control mechanism in accordance with aspects of the present invention. Each of the sand control devices 300*a* and 300*b* include a tubular member or base pipe 302 surrounded by a sand screen 304 having ribs 305. The sand screen 304 may include a permeable section, such as a wire-wrapped screen or filter medium, and a non-permeable section, such as a section of blank pipe. The ribs 305, which are not shown in FIGS. 3A and 3F for simplicity, are utilized to keep the sand screen 304 a specific distance from the base pipe 302. The space between the base pipe 302 and sand screen 304 form a chamber that is accessible from the fluids external to the sand control device 300*a* and 300*b* via the permeable section. In FIGS. 3A-3G, the sand control devices 300*a* and 300*b*, which may collectively be referred to as sand control device 300, are the same embodiment of a sand control device in different stages of operation, such as during gravel packing and production operations. Beneficially, in the sand control device 300, a sealing element 312 is configured to provide one or more flow paths to the openings 310 and/or inflow control device 308 during gravel packing operations and to block the flow path to the openings 310 prior to or during production operations. As such, the sand control device 300 may be utilized to enhance operations within the well.

In FIGS. 3A-3G, the sand control devices 300*a* and 300*b*, which may collectively be referred to as sand control device 300, may include various components utilized to manage the flow of fluids and solids into a well. For instance, the sand control device 300 includes a main body section 320, an inflow section 322, a first connection section 324, a perforated section 326 and a second connection section 328, which may be made of steel, metal alloys, or other suitable materials. The main body section 320 may be a portion of the base pipe 302 surrounded by a portion of the sand screen 304. The main body section 320 may be configured to be a specific length, such as between 10 and 50 feet (ft) (with certain sections being 6 ft, 8 ft, 14 ft, 38, or 40 ft) having specific internal and outer diameters. The inflow section 322 and perforated section 326 may be other portions of the base pipe 302 surrounded by other portions of the sand screen 304, such non-permeable sections, which may include components that provide flow paths through the base pipe 302. The inflow section 322 and perforated section 326 may be configured to be between 0.5 ft and 4 ft in length. The first and second connection sections 324 and 328 may be utilized to couple the sand control device 300 to other sand control devices or piping, and may be the location of the chamber formed by the base pipe 302 and sand screen 304 ends. The first and second connection sections 324 and 328 may be configured to be a specific length, such as 2 inches (in) to 4 ft or other suitable distance, having specific internal and outer diameters.

In some embodiments of the present invention within the first and second connection sections 324 and 328, coupling mechanisms may be utilized to form the secure and sealed connections. For instance, a first connection 330 may be positioned within the first connection section 324, and a second connection 332 may be positioned within the second connection section 328. These connections 330 and 332 may include various methods for forming connections with other devices. For example, the first connection 330 may have internal threads and the second connection 332 may have external threads that form a seal with other sand control devices or another pipe segment. It should also be noted that in other embodiments, the coupling mechanism for the sand control device 300 may include connecting mechanisms as described in U.S. Pat. No. 6,464,261; U.S. Patent No. 60/775,434; Intl. Patent Application No. WO2004/046504; Intl. Patent Application No. WO2004/094769; Intl. Patent Application No. WO2005/031105; U.S. Patent Application Pub. No. 2004/0140089; U.S. Patent Application Pub. No. 2005/0028977; U.S. Patent Application Pub. No. 2005/0061501; U.S. Patent Application Pub. No. 2005/0082060; U.S. Patent App. No. 60/765,023; and U.S. Patent App. No. 60/775,434, for example.

In some embodiments of the present invention within the inflow section 322 and perforated section 326, flow control mechanisms may be utilized to regulate flow paths or pressure loss within the sand control device. As a specific example, the sand control device 300 may include one or more inflow control devices 308, one or more perforations or openings 310, and a sealing element 312. The inflow control devices 308 may be positioned at one end of the sand control device 300 and openings 310 along with the sealing element 312 at the other end of the sand control device 300. Inflow control devices 308 may be utilized to control the flow of formation fluids from the chamber into the base pipe 302 during gravel packing and/or production operations. The inflow control devices 308 may include nozzles, valves, tortuous paths, shaped objects or other suitable mechanisms known in the art to create a pressure drop or pressure loss. In particular, the inflow control devices 308 may choke flow through form pressure loss (e.g. a shaped object, nozzle) or frictional pressure loss (e.g. helical geometry/tubes).

Form pressure loss, which is based on the shape and alignment of an object relative to fluid flow, is caused by separation of fluid that is flowing over an object, which results in turbulent pockets at different pressure behind the object. The openings 310 may be utilized to provide additional flow paths for the fluids, such as carrier fluids, during gravel packing operations because the inflow control devices 308 may restrict the placement of gravel by hindering the flow of carrier fluid into the base pipe 302 during gravel packing operations. The number of openings in the base pipe 302 may be selected to provide adequate inflow during the gravel packing operations to achieve partial or substantially complete gravel pack. That is, the number and size of the openings in the base pipe 302 may be selected to provide sufficient fluid flow from the wellbore through the sand screen 304, which is utilized to deposit gravel in the wellbore and form the gravel pack. As known in the art, alternate path gravel packing techniques with proper fluid leak-off through the sand screen 304 has been demonstrated in the field to achieve a complete gravel pack.

In some embodiments of the present invention the sealing or expansion element 312 may surround the base pipe 302 and may be a hydraulically actuated inflatable element (i.e. an elastomer or thermoplastic material) or a swellable material (i.e. a swelling rubber element or swellable polymer). The swellable material may expand in the presence of a stimulus, such as water, conditioned drilling fluid, a completion fluid, a production fluid (i.e. hydrocarbons), other chemical, or any combination thereof. As an example, a swellable material may be placed in the sand control device 300, which expands in the presence of hydrocarbons to form a seal between the walls of the base pipe 302 and the non-permeable section of the sand screen 304 (See e.g. Easy Well Solutions' CONSTRICTOR™ or SwellFix's E-ZIP™ or P-ZIP™). Further, the sealing element 312 may be activated chemically, mechanically by the removal of a washpipe, and/or via a signal, electrical or hydraulic, to isolate the openings 310 from the fluid flow during some or all of the production operations. For alternative views of the sand control devices 300*a* and 300*b*, cross sectional views of the components is shown along the line AA in FIG. 3B, along the line BB in FIG. 3C, along the line CC in FIG. 3D, along the line DD in FIG. 3E, and along the line EE in FIG. 3G.

Figure 3A:
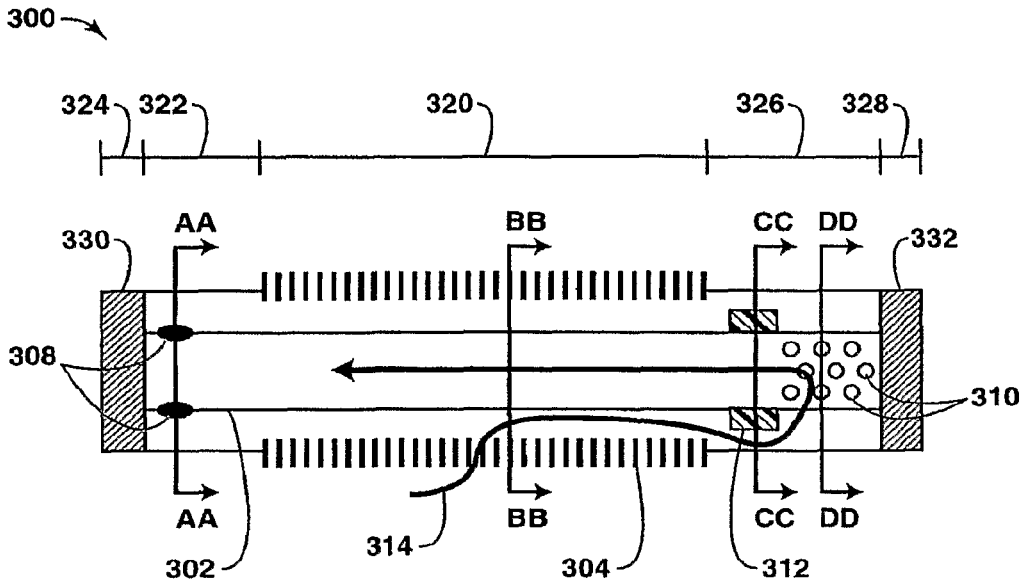
FIGS. 3A-3G are illustrative views of an embodiment of a sand control device utilized in the production system of FIG. 1 with an inflow control mechanism having a sealing element in accordance with aspects of the present invention.
Figure 3B:
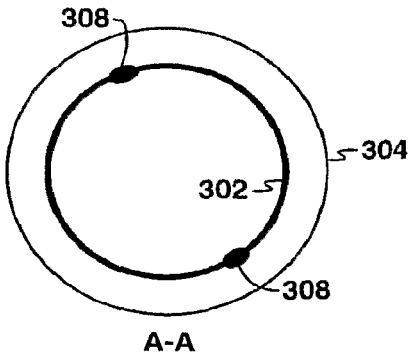
Figure 3C:
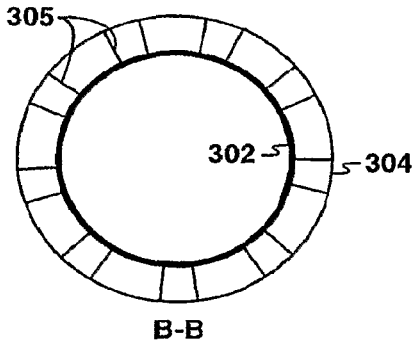
Figure 3D:
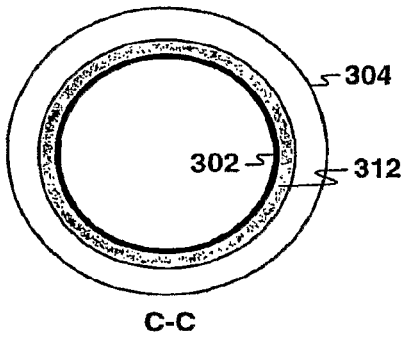
Figure 3E:
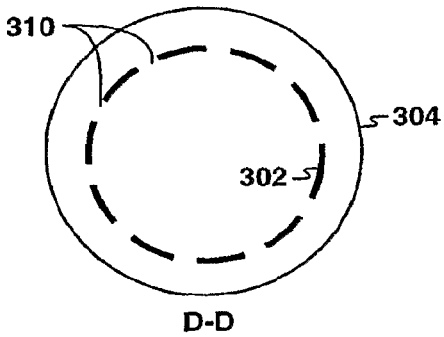
Figure 3F:
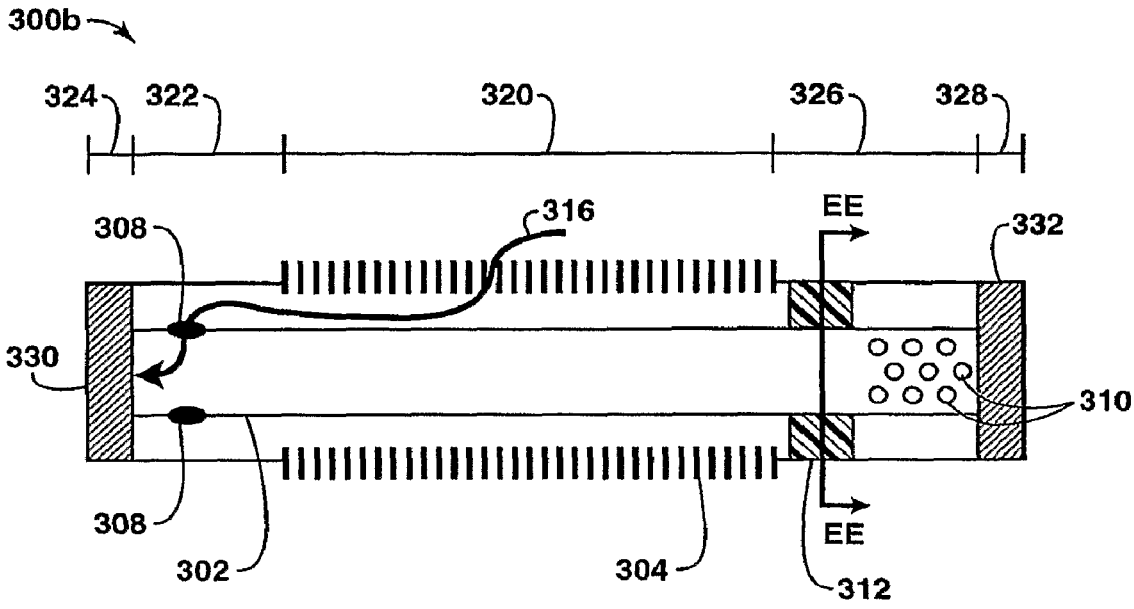
Figure 3G:
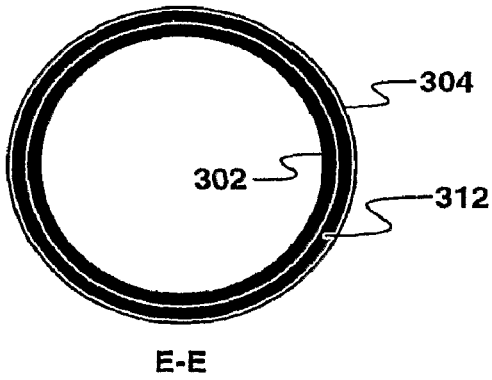

Some embodiments of the operation of the sand control device 300 are further described with reference to FIGS. 3A and 3F. In FIG. 3A, the sand control device 300*a* is run to a specific location within the wellbore. The sand control device 300*a*, which may be coupled to a crossover tool, provides one or more flow paths 314 for carrier fluid through the sand screen 304 and openings 310 into the base pipe 302 during the gravel packing operations. The carrier or gravel pack fluid may include XC gel (xanthomonas campestris or xanthan gum), visco-elastic fluids having non-Newtonian rheology properties, a fluid viscosified with hydroxyethylcellulose (HEC) polymer, a fluid viscosified with refined xanthan polymer (e.g. Kelco's XANVIS®), a fluid viscosified with visco-elastic surfactant, and/or a fluid having a favorable rheology and sand carrying capacity for gravel packing the subsurface formation of the wellbore using the at least one sand control device with alternate path technology. During the gravel packing operations, the sealing element 312 does not block the flow path 314 and provides an alternative flow path for carrier fluid in addition to the inflow control devices 308. Once the gravel pack is formed, production operations may begin as shown in FIG. 3F. In FIG. 3F, the sealing element 312 actuates to block fluid flow through the openings 310. As a result, the sand control device 300*b*, which may be coupled to a production tubing string 128 or other piping, may provide one or more flow paths 316 for formation fluids through the sand screen 304 and inflow control devices 308 into the base pipe 302. Thus, in the embodiment, the openings 310 are isolated to limit fluid flow to only the inflow control devices 308, which are designed to manage the flow of fluids from the interval 108.

As a specific example, the sand control device 300 may be run in a water-based mud with a hydrocarbon-swellable material used for the sealing element 312. During screen running and gravel packing operations, the chamber between the base pipe 302 and the sand screen 304 is open for fluid flow through the inflow control devices 308 and/or openings 310. However, during production operations, such as post-well testing operations, the sealing element 312 comprising a hydrocarbon-swellable material expands to close off the chamber within the perforated section 326. As a result, the fluid flow is limited to the inflow control devices 308 once the sealing element 312 comprising a hydrocarbon-swellable material isolates the openings 310.

Alternatively, as another example, if the sand control device 300 is run in an oil-based mud, such as non-aqueous fluid (NAF), a hydrocarbon-swellable material may again be used for the sealing element 312. In this example, the process of expanding the sealing element 312 is evaluated to determine the time associated with isolating the openings to prevent fluid flow in the well. The material comprising the sealing element 312 may be formulated so that the sealing element 312 swells at a known rate in the NAF. Alternatively, a coating or covering of a semi-permeable material that may prevent early swelling of the sealing element 312 may be applied to the sealing element 312. In either case, the expansion process may be designed to proceed at a specified rate to enable certain operations to be performed within the wellbore. After the sealing element 312 swells, the formation fluid is able to enter the interior of the base pipe 302 only through the inflow control devices 308.

Beneficially, the sand control device 300 with a swellable material may be a passive system that may automatically adjust to manage the flow of fluids into the production tubing string 128. Further, this embodiment is not complex, which reduces manufacturing costs. In addition, the sand control device 300 also provides various operational enhancements. For instance, based on the expansion of the swelling material, full well tests may be performed on the intervals within the subsurface formation before flow is diverted to only the inflow control devices 308. In addition, production operations, such as remediation or treatment operations may be performed by using chemicals, such as acids, to dissolve or shrink the swellable material to increase flow from an individual interval within the well. Alternatively, an electrical or hydraulic signal may also be used to shrink the material. Another alternative embodiment of the sand control device 300 is further described in FIGS. 4A-4G.

FIGS. 4A-4G are illustrative views of a first alternative embodiment of the sand control device of FIGS. 3A-3G in accordance with aspects of the present invention. In FIGS. 4A-4G, the sand control devices 400*a* and 400*b*, which may collectively be referred to as sand control device 400, are alternate views of a sand control device 400 in different stages of operation, such as gravel packing and production. Accordingly, the sand control device 400 utilizes the reference numerals for similar components to those described above in FIG. 3. In particular, the sand control device 400 may include a main body section 410, an inflow section 412, a first connection section 414, a perforated section 416 and a second connection section 418, which are made of steel or metal alloys. Each of these sections 410-418 may include similar features, operate in a similar manner, and include similar materials to the respective sections 320-328 discussed above.

However, in this alternative embodiment, the shunt tubes 402 have been included with the sand control device 400. The shunt tubes 402 may include packing tubes and/or transport tubes and may also be utilized with the sand screens 304 for gravel packing and other operations within the wellbore. The packing tubes may have one or more valves or nozzles (not shown) that provide a flow path for the gravel pack slurry, which includes a carrier fluid and gravel, to the annulus formed between the sand screen 304 and the walls of the wellbore. The valves may prevent fluids from an isolated interval from flowing through the at least one shunt tubes to another interval. These shunt tubes are known in the art as further described in U.S. Pat. Nos. 5,515,915, 5,890,533, 6,220,345 and 6,227,303.

Accordingly, in this embodiment, the sand control device 400 includes inflow control devices 308, openings 310, a sealing element 312 and shunt tubes 402. In this embodiment, the sealing element 312 may include multiple individual sections or portions, such as a plurality of sealing element 312 sections, positioned between adjacent shunt tubes 402 or a single sealing element 312 with openings for the shunt tubes 402. The plurality of sealing element sections 312, which may include hydraulically actuated inflatable elements or swellable materials, may block fluid flow to the openings 310 within the sand control device 400. For an alternative perspective of the sand control devices 400*a* and 400*b*, cross sectional views of some of the various components are shown along the line FF in FIG. 4B, along the line GG in FIG. 4C, along the line HH in FIG. 4D, along the line 11 in FIG. 4E, and along the line JJ in FIG. 4G.

Figure 4A:
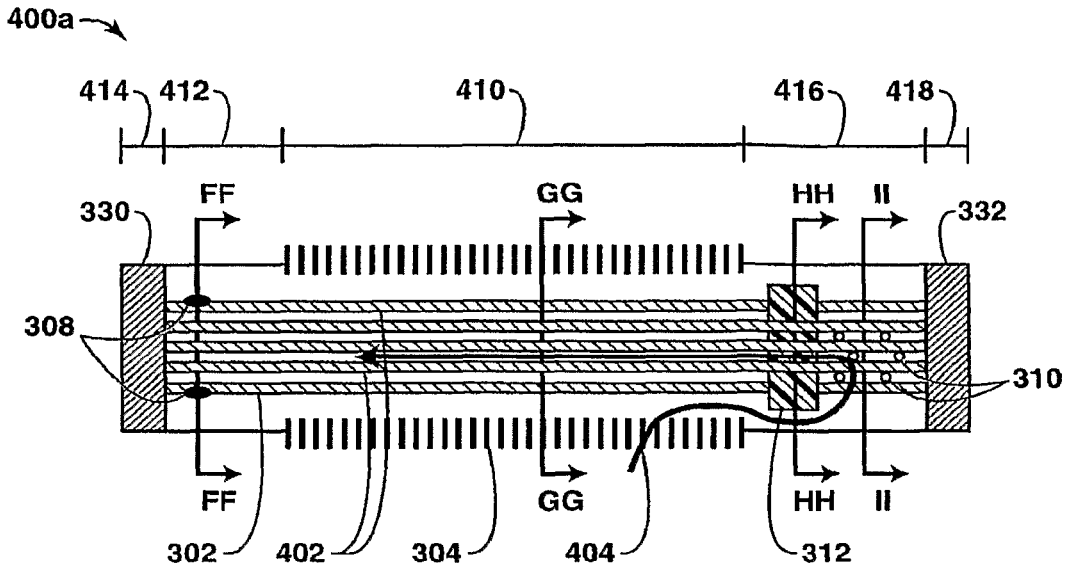
FIGS. 4A-4G are illustrative views of a first alternative embodiment of the sand control device of FIGS. 3A-3G in accordance with aspects of the present invention.
Figure 4B:
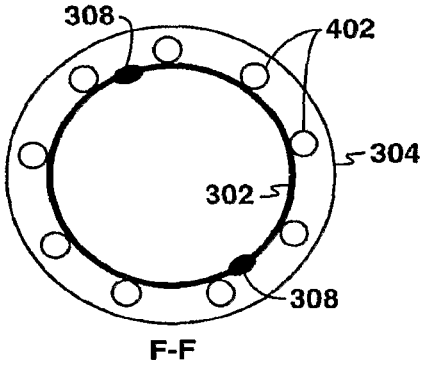
Figure 4C:
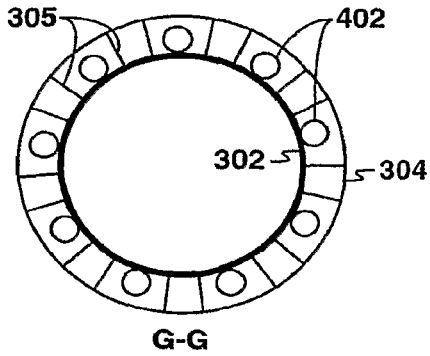
Figure 4D:
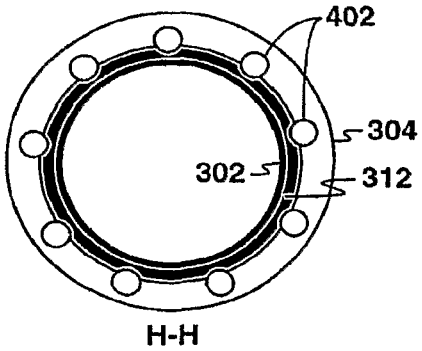
Figure 4E:
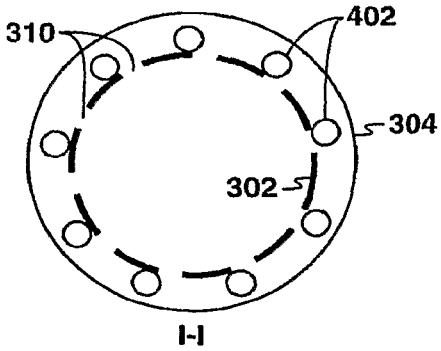
Figure 4F:
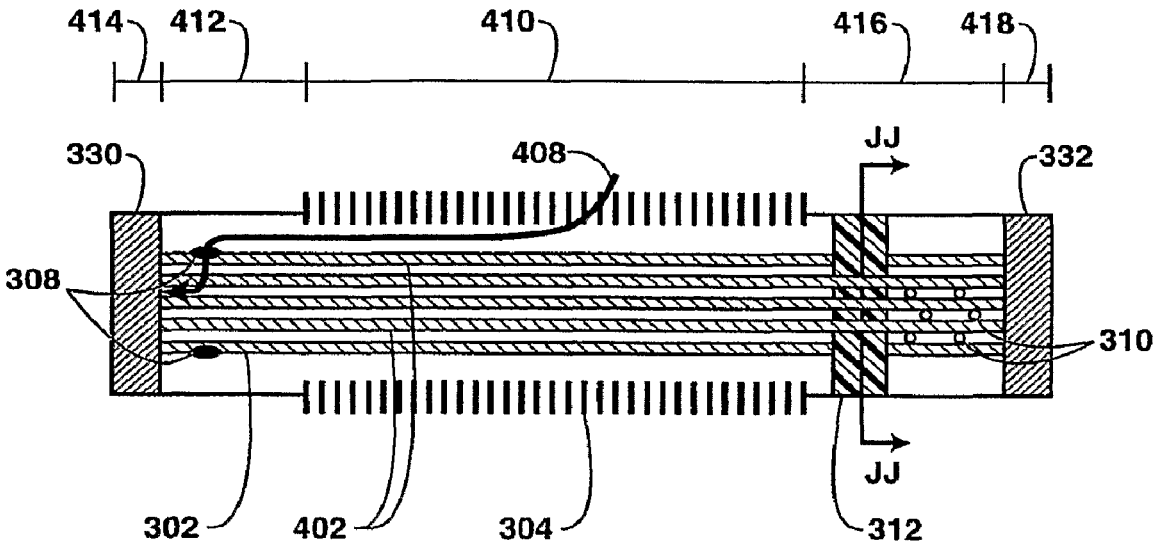
Figure 4G:
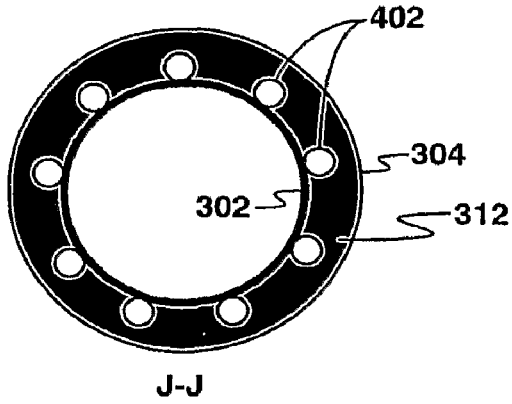
Figure 5A:
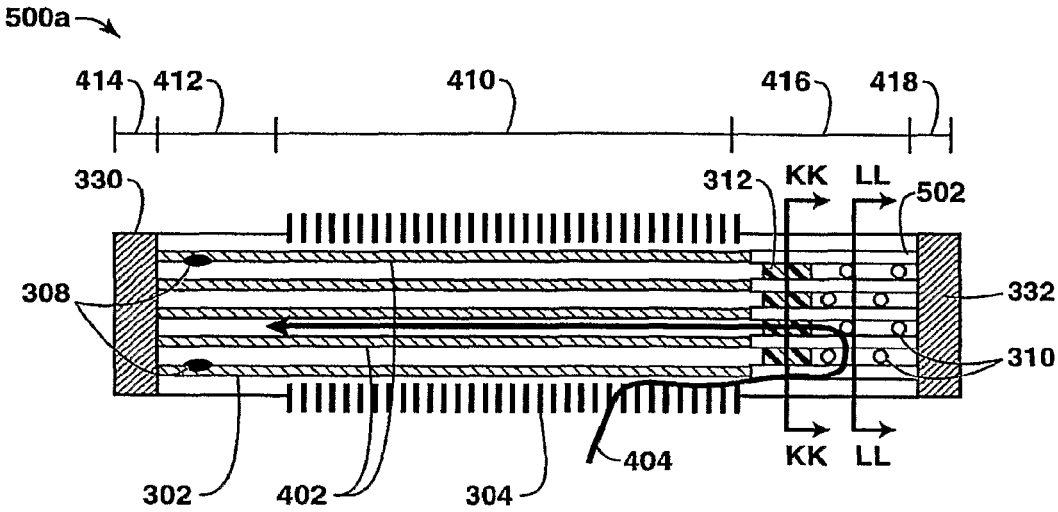
FIGS. 5A-5F are illustrative views of a second alternative embodiment of the sand control device of FIGS. 3A-3G in accordance with aspects of the present invention.
Figure 5B:
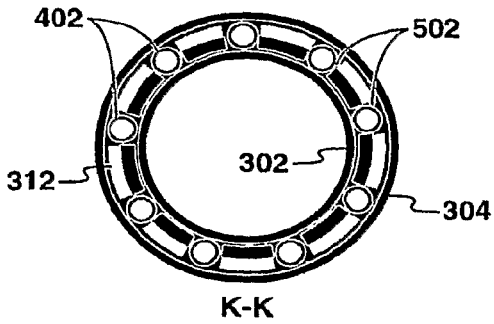
Figure 5C:
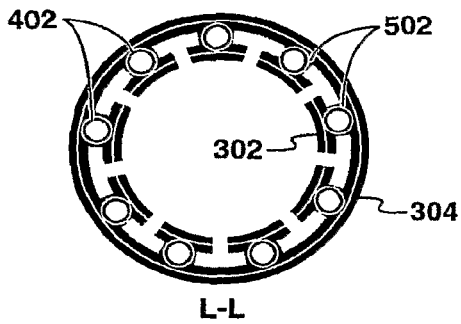
Figure 5D:
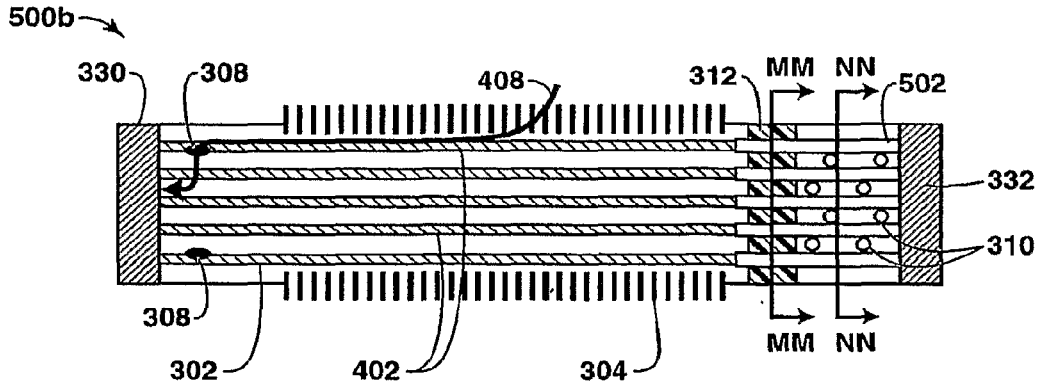
Figure 5E:
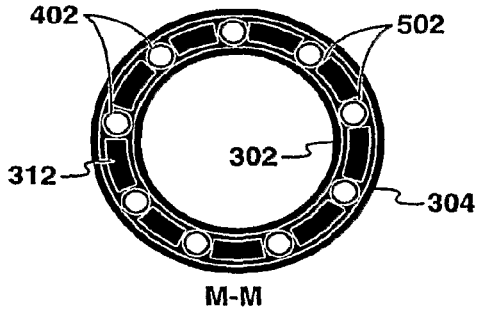
Figure 5F:
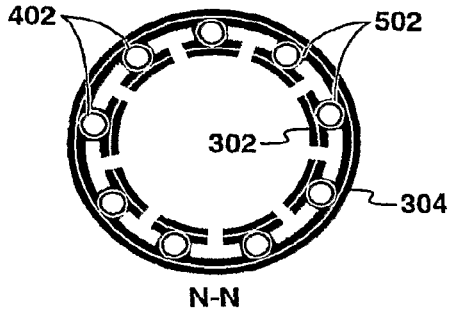
Figure 6A:
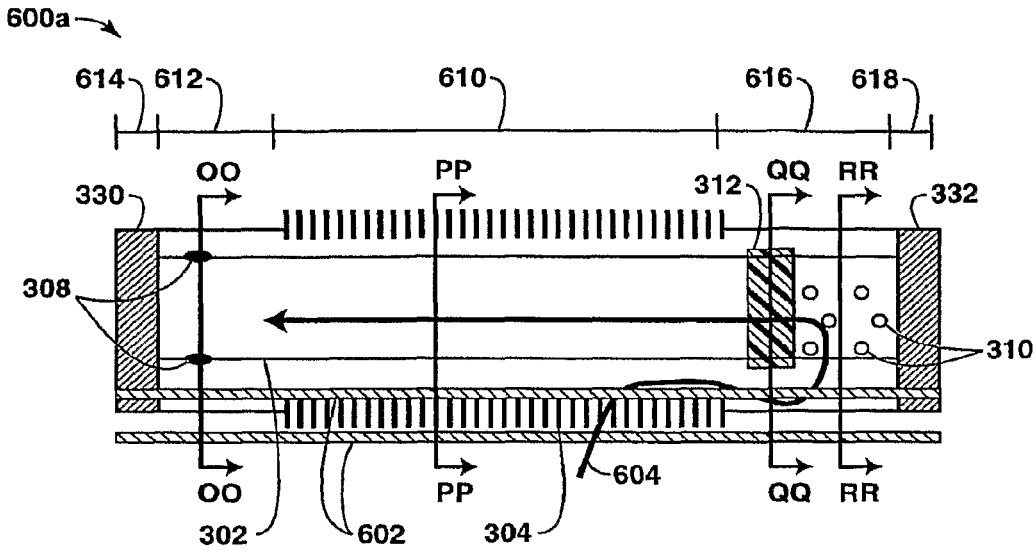
FIGS. 6A-6G are illustrative views of a third alternative embodiment of the sand control device of FIGS. 3A-3G in accordance with aspects of the present invention.
Figure 6B:
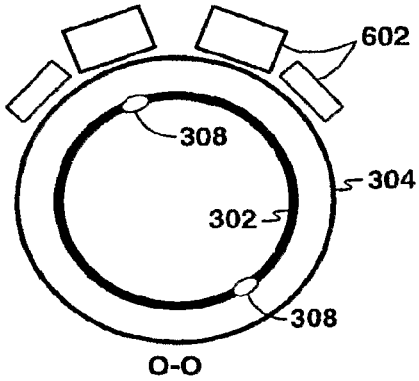
Figure 6C:
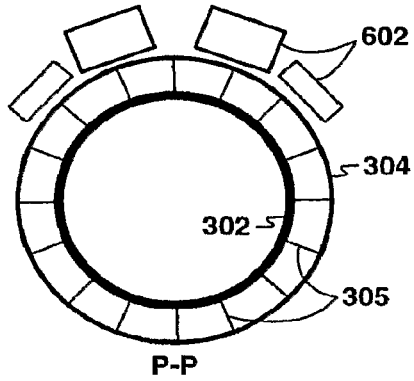
Figure 6D:
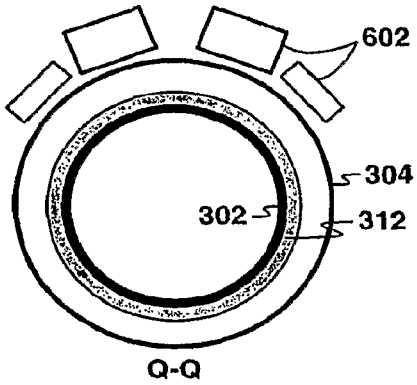
Figure 6E:
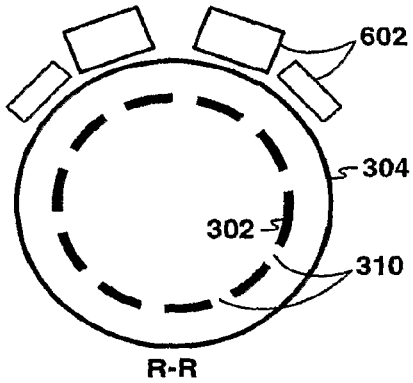
Figure 6F:
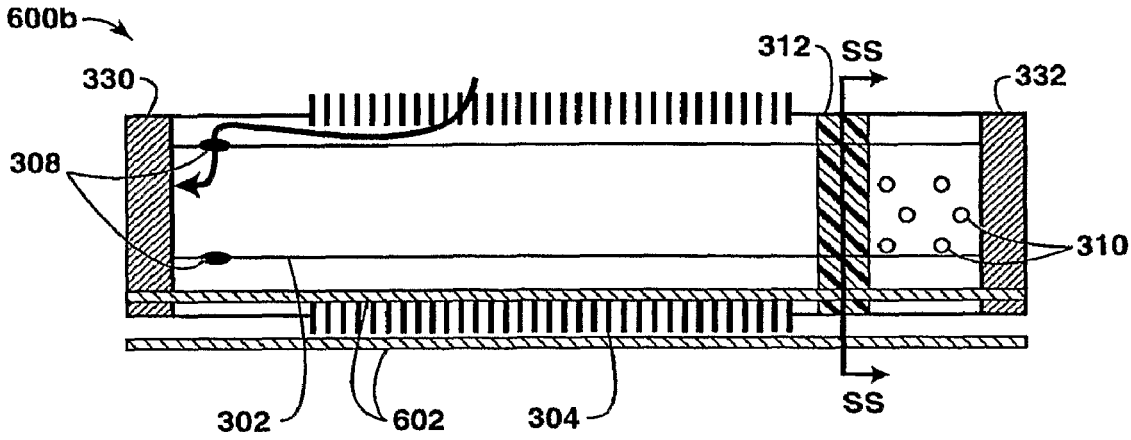
Figure 6G:
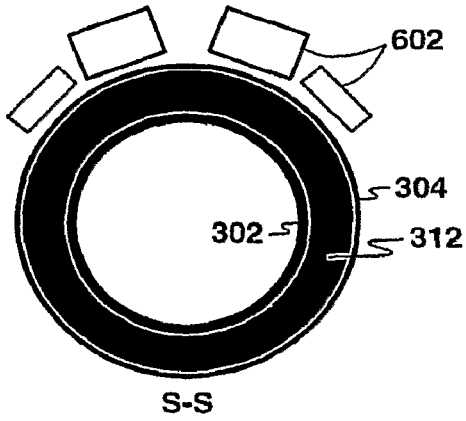

Some embodiments of the operation of the sand control device 400 are further described with reference to FIGS. 4A and 4F. In FIG. 4A, the sand control device 400*a* is run to a specific location within the wellbore. The sand control device 400*a*, which may be coupled to a crossover tool, provides one or more flow paths 404 for carrier fluid through the sand screen 304 and openings 310 into the base pipe 302. During the gravel packing operations, the sealing element 312 does not block the flow path 404 and provides an alternative flow path for carrier fluid in addition to the inflow control devices 308. Once the gravel pack is formed, production operations may begin as shown in FIG. 4F. In FIG. 4F, the individual sections of the sealing element 312 swell to block fluid flow through the openings 310. As a result, the sand control device 400*b*, which may be coupled to a production tubing string 128 or other piping, may provide one or more flow paths 408 for formation fluids through the sand screen 304 and inflow control devices 308 into the base pipe 302. Thus, the openings 310 are isolated to limit flow through the inflow control devices 308, which manages the flow of fluids from the interval 108. Beneficially, by utilizing the shunt tubes 402, longer portions of intervals may be packed without leaking off into the formation. The leaking off into the formation typically is one of the causes of an incomplete gravel pack. Accordingly, the shunt tubes 402 providing a mechanism for forming a substantially complete gravel pack along the sand screen that bypasses sand and/or gravel bridges.

FIGS. 5A-5F are illustrative views of yet another alternative embodiment of the sand control device of FIGS. 3A-3G in accordance with aspects of the present invention. In FIGS. 5A-5F, the sand control devices 500*a* and 500*b*, which may collectively be referred to as sand control device 500, are alternate views of a sand control device 500 in different stages of operation, such as gravel packing and production. The sand control device 500 operates in a similar manner as the flow control device 400 and utilizes similar components to those described above in FIGS. 3A-3G and 4A-4G. However, in this embodiment, the sealing element 312 and shunt tubes 402 are configured to engage with support members 502 that function similar to the ribs 305 to separate the base pipe 302 from the sand screen 304. The support members 502 may seal with the shunt tubes 402 and support the shunt tubes 402 in one embodiment. Alternatively, the support members 502 may be coupled to the shunt tubes 402 via welds or threaded connections to provide an isolated flow path for fluids from each of the shunt tubes 402 through this portion of the sand control device 500. The support members 502 may be made from steel, metal alloy or other suitable material. Each of the support members 502 are positioned around or coupled to one of the shunt tubes 402 and between the base pipe 302 and the sand screen 304. The sealing element 312 is positioned between adjacent support members 502; which form a defined space for the sections of the sealing element 312 to expand and form a seal between the support members 502, base pipe 302 and sand screen 304. For an alternative perspective of the sand control devices 500*a* and 500*b*, cross sectional views of some of the various components are shown along the line KK in FIG. 5B, along the line LL in FIG. 5C, along the line MM in FIG. 5E and along the line NN in FIG. 5F.

FIGS. 6A-6G are illustrative views of still another alternative embodiment of the sand control device of FIGS. 3A-3G in accordance with aspects of the present invention. In FIGS. 6A-6G, the sand control devices 600*a* and 600*b*, which may collectively be referred to as sand control device 600, are alternate views of a sand control device in different stages of operation, such as gravel packing and production. Accordingly, the sand control device 600 utilizes the reference numerals for similar components to those described above in FIGS. 3A-3G and 4A-4G. In particular, the sand control device 600 may include a main body section 610, an inflow section 612, a first connection section 614, a perforated section 616 and a second connection section 618, which may be made from steel or metal alloys. Each of these sections 610-618 may include similar features, operate in a similar manner, and include similar materials to the respective sections 320-328 discussed above.

However, in this embodiment, the shunt tubes 602 are external to the sand screen 304. Similar to the shunt tubes 402 noted above, the shunt tubes 602 may include packing tubes, transport tubes, valves and other components utilized for gravel packing an interval within the wellbore. These shunt tubes, which may include any number of geometries, are known in the art and further described in U.S. Pat. Nos. 4,945,991 and 5,113,935.

In some embodiments of the present invention, the sand control device 600 includes inflow control devices 308, openings 310, a sealing element 312, and shunt tubes 602, which operate similar to the discussion above. In particular, the sealing element 312, which may be a single element or plurality of sealing sections, may operate in a similar manner to the discussion of FIGS. 4A-4G. That is, the sand control device 600*a* of FIG. 6A, which may be coupled to a crossover tool, provides one or more flow paths 604 for carrier fluid through the sand screen 304 and openings 310 into the base pipe 302 during the gravel packing operations. Once the gravel pack is formed, the sand control device 600*b*, which may be coupled to a production tubing string 128 or other piping, may provide one or more flow paths 608 for formation fluids through the sand screen 304 and inflow control devices 308 into the base pipe 302, as shown in FIG. 4F. For an alternative perspective of the sand control devices 600*a* and 600*b*, cross sectional views of some of the components are shown along the line OO in FIG. 6B, along the line PP in FIG. 6C, along the line QQ in FIG. 6D, along the line RR in FIG. 6E, and along the line SS in FIG. 6G.

Figure 7A:
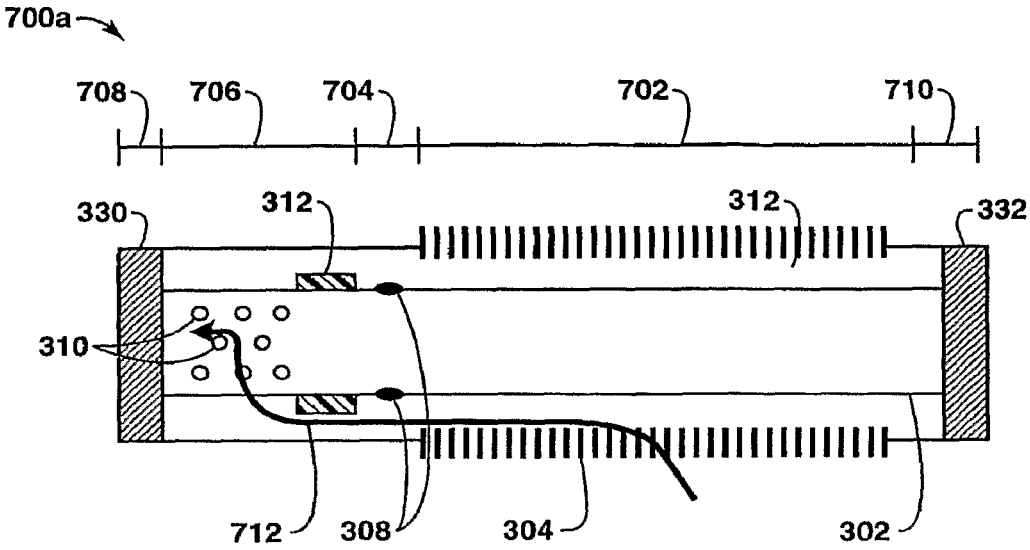
FIGS. 7A-7B are illustrative views of another alternative embodiment of a sand control device utilized in the production system of FIG. 1 with an inflow control mechanism having a sealing element in accordance with aspects of the present invention.
Figure 7B:
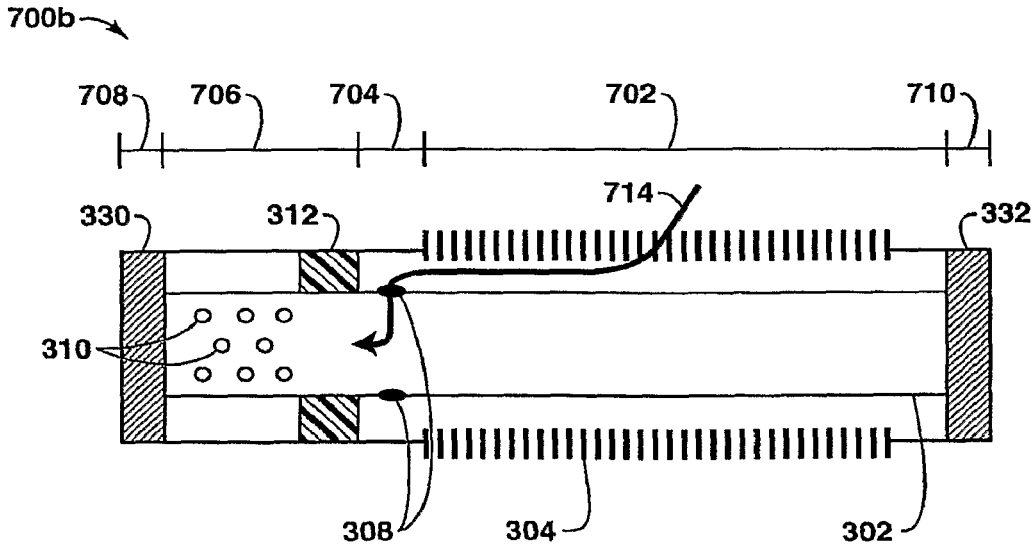

As another example, FIGS. 7A-7B are illustrative views of another alternative embodiment of a sand control device utilized in the production system of FIG. 1 having an inflow control mechanism having a sealing element in accordance with aspects of the present invention. Similar to the discussion of FIGS. 3A-3G, the sand control devices 700*a* and 700*b*, which may collectively be referred to as sand control device 700, are alternate views of a sand control device in different stages of operation, such as gravel packing and production. The sand control device 700 has inflow control devices 308, openings 310 and sealing element 312, which operate similar to the discussion above. However, with this embodiment of the sand control device 700, the inflow control devices 308, openings 310 and sealing element 312 are positioned on the same end of the sand control device 700.

In some embodiments of the present invention, the sand control device 700 includes various sections, such as a main body section 702, an inflow section 704, a perforated section 706, a first connection section 708 and a second connection section 710, which are made of steel or metal alloys, as noted above. The main body section 702 and connection sections 708 and 710 may be configured similar to the sections 320, 324 and 328, which are discussed above. However, in this embodiment, while the inflow section 704 and perforated section 706 may be configured to have similar lengths to 322 and 326, as discussed of FIGS. 3A-3G, the inflow section 704 and perforated section 706 are positioned on the same end of the sand control device 700.

In some embodiments of the present invention, the sand control device 700 is run to a specific location within the wellbore. In FIG. 7A, the sand control device 700, which may be coupled to a crossover tool, provides one or more flow paths 712 for carrier fluid through the sand screen 304 and openings 310 into the base pipe 302. Again, during the gravel packing operations, the sealing element 312 does not block the flow path 712 to provide an alternative flow path for carrier fluid. Once the gravel pack is formed, production operations may begin as shown in FIG. 7B. In FIG. 7B, the sealing element 312 swells to block fluid flow through the openings 310. As a result, the sand control device 700*b*, which may be coupled to a production tubing string 128 or other piping, may provide one or more flow paths 714 for formation fluids through the sand screen 304 and inflow control devices 308 into the base pipe 302. Thus, the openings 310 are isolated to limit flow through the inflow control devices 308, which manage the flow of fluids from the interval 108.

Sand Control Device with Conduit

Figure 8A:
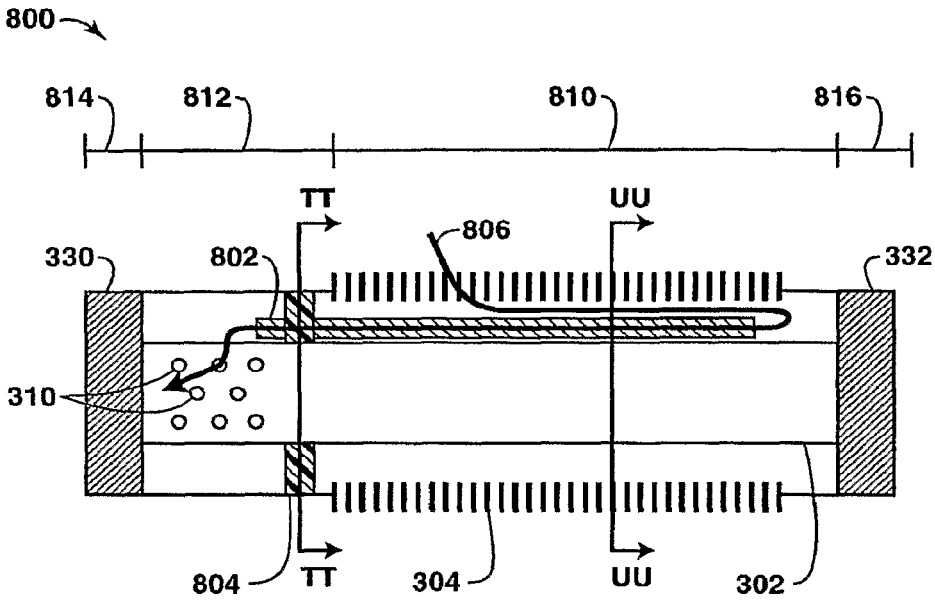
FIGS. 8A-8C are illustrative views of an embodiment of a sand control device utilized in the production system of FIG. 1 with an inflow control mechanism having a conduit in accordance with aspects of the present invention.
Figure 8B:
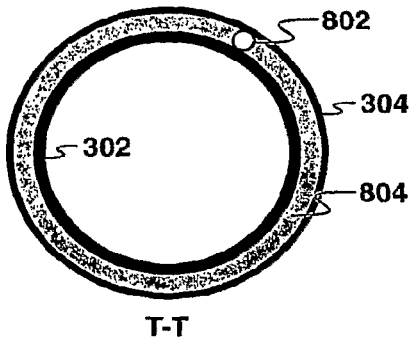
Figure 8C:
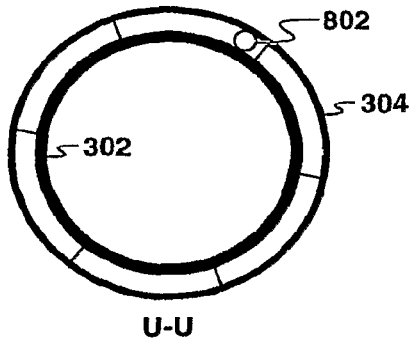
Figure 9A:
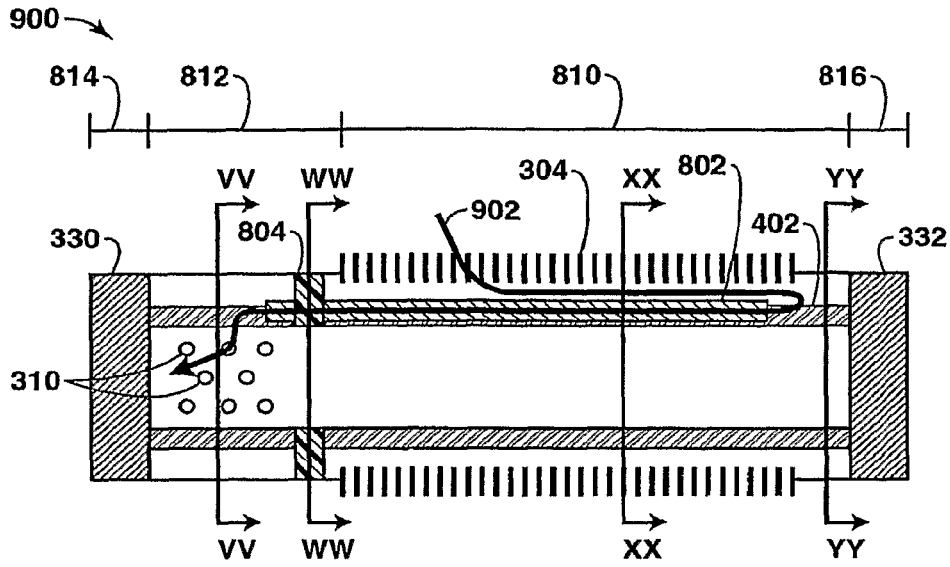
FIGS. 9A-9E are illustrative views of a first alternative embodiment of sand control device of FIGS. 8A-8C in accordance with aspects of the present invention.
Figure 9B:
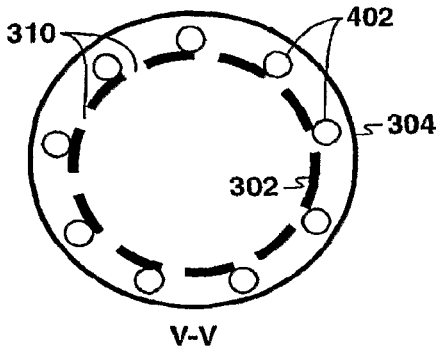
Figure 9C:
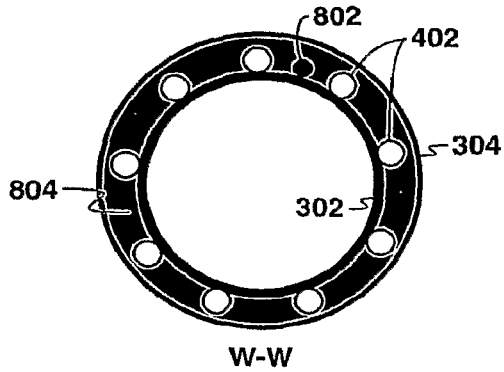
Figure 9D:
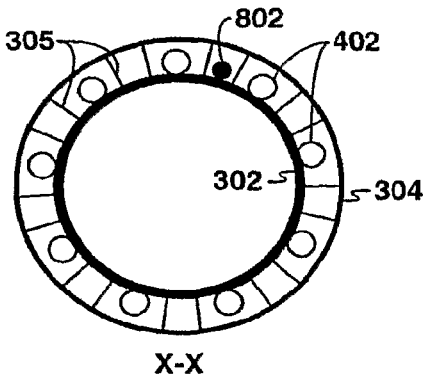
Figure 9E:
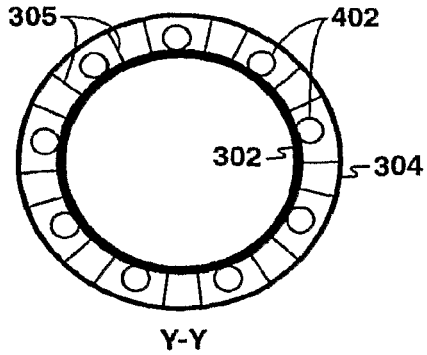

FIGS. 8A-8C are illustrative views of an embodiment of a sand control device utilized in the production system of FIG. 1 with an inflow control mechanism having a conduit in accordance with aspects of the present invention. In FIGS. 8A-8C, the sand control device 800 utilizes the reference numerals for similar components to those described above in FIGS. 3A-3G. However, in this embodiment, one or more conduits, which are shown as a single conduit 802 for simplicity, and barrier element 804 are utilized to provide the frictional pressure loss for the sand control device instead of the inflow control devices 308. Accordingly, the conduit 802 and barrier element 804 may enhance gravel packing and production operations within the wellbore, as described herein.

In an exemplary embodiment 800, the sand control device 800 includes a main body section 810, a perforation section 812, a first connection section 814 and a second connection section 816, which may be made from steel or metal alloys. Similar to the sections 320, 324 and 326 of FIGS. 3A-3G, the sections 810, 814 and section 816 may be made from similar material, include similar components and be configured in a similar manner, as noted above. The perforated section 812 may be made of steel and/or metal alloys and configured to be between about 4 in and about 4 ft, having specific internal and outer diameters.

In an exemplary embodiment, the sand control device 800 includes a conduit 802 and barrier element 804 that are used to manage the flow of fluids during the gravel packing and production operations. The conduit 802 may include one or more tubes (similar to a shunt tube 402 of FIG. 4), one or more channels, or other similar fluid passages. The conduit 802 extends between the isolated chambers formed between the base pipe 302, sand screen 304 and barrier element 804 within the main body section 302 and the perforated section 812. The conduit 802 has a pre-defined diameter and length to provide adequate leak-off during the gravel pack process to achieve a complete or substantially complete pack. For instance, in different embodiments, the conduit 802 may have diameter from ¼ in to 1 in, may include from 1 to 36 conduits, and have a length d of about 10 feet (ft) to about 50 ft. In addition, the diameter and length of the tube may be selected to provide sufficient choking through frictional pressure losses during production operations to operate similar to inflow control devices. The diameter and length of the conduit 802 may be determined from experience, fluid properties, modeling and/or calculations (i.e. computational fluid dynamics calculations or equations that involve the properties of the carrier fluid and formation fluids for the different operations). The barrier element 804 may be formed from steel, metal alloys, swellable material (i.e. the sealing element 312), and/or other suitable material that forms to isolate the chambers in the main body section 810 and the perforated section 812 from each other. For an alternative perspective of the sand control device 800, a cross sectional view of the components is shown along the line TT in FIG. 8B and along the line UU in FIG. 8C.

In some methods of operation of the present invention, the sand control device 800 is run to a specific location within the wellbore. During gravel packing and production operations, fluid flows along the flow path 806, which enters through the sand screen 304 into the first chamber, flows through the conduit 802 to the second chamber, and enters the base pipe 302 through the perforations 310. For gravel packing operations, the carrier fluid flows through the conduit 802 in a manner that allows the gravel pack to be formed around the sand control device 800. Accordingly, the carrier fluid utilized for the gravel packing operations may be designed to have reduced friction loss properties relative to water or hydrocarbons. For example, the carrier fluid may include fluids used for alternate path gravel packing operations, as noted above. By selecting carrier fluids with low friction loss properties, the carrier fluid and gravel may be flowed through the well to form the gravel pack that is substantially complete. However, hydrocarbon and water production, which inherently have higher frictional pressure drop, are more restricted resulting in an inflow control effect.

As a specific example, the pressure loss for conduits may be calculated and utilized to select the pipes, which enhance operations over inflow control devices, such as nozzles. Specifically, if the pressure losses during production operations are calculated to utilize two 4 millimeter (mm) nozzles, then two conduits having a length of 30 ft and a diameter of 10 mm may be utilized during production operations. The pressure loss or choking, for both the nozzles and conduits, is about 150 psi at 550 barrels of oil per day (bopd) per screen joint. However, the nozzles and conduits may function differently during gravel packing operations. For instance, the carrier fluid may be an XC gel that flows at ½ barrel per minute (bpm) for each sand control device. The resulting pressure loss of the nozzles, which may be about 500 pounds per square inch (psi), is about 5 times the pressure loss of two conduits, which may be about 100 psi.

Beneficially, the conduit 802 and chamber formed by the barrier element 804 are utilized to choke the flow of hydrocarbons and water with frictional pressure losses, as opposed to pressure losses from inflow control devices or nozzles. While both techniques operate in a similar manner for production operations, the conduit 802 provides a mechanism for gravel packing operations to be performed efficiently, while the inflow control devices only tend to choke back the carrier fluid and hinder gravel pack formation.

Another alternative embodiment of the sand control device 800 is further described in FIGS. 9A-9E. FIGS. 9A-9E are illustrative views of a first alternative embodiment of sand control devices of FIGS. 8A-8C in accordance with aspects of the present invention. FIGS. 9A-9E show alternative views of the sand control device 900 in different stages of operation, such as gravel packing and production, with the addition of internal shunt tubes 402. Accordingly, the sand control device 900 utilizes the reference numerals for similar components to those described above in FIGS. 3A-3G, 4A-4G and 8A-8C. In this embodiment, the shunt tubes 402 have been included with the sand control device 900 to provide a mechanism for gravel packing other portions of the wellbore through the sand control device 900, as is described below. Again, as noted above, the shunt tubes 402 may include packing tubes and/or transport tubes and may also be utilized with the sand screens 304 for gravel packing within the wellbore.

In FIGS. 9A-9G, the sand control device 900 includes openings 310, shunt tubes 402, conduit 802 and barrier element 804. The barrier element 804 is positioned between the base pipe 302 and the sand screen 304 to isolate the chambers in the main body section 810 and the perforated section 812 from each other. Accordingly, in this embodiment, the barrier element 804 may include multiple individual sections, such as a plurality of barrier sections, positioned between adjacent shunt tubes 402 and/or conduit 802 or may be a single element with openings for the shunt tubes 402 and/or conduit 802. Fluid from the interval may flow along the path 902 for gravel packing and production operations. For an alternative perspective of the sand control device 900, cross sectional views of some of the components are shown along the line W in FIG. 9B, along the line WW in FIG. 9C, along the line XX in FIG. 9D and along the line YY in FIG. 9E.

Figure 10A:
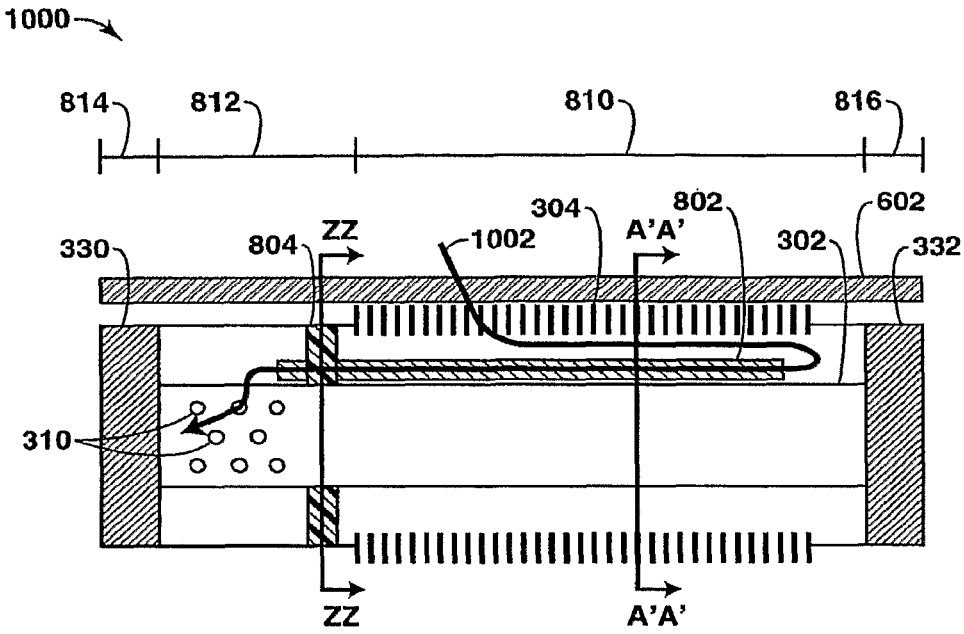
FIGS. 10A-10C are illustrative views of a second alternative embodiment of sand control device of FIGS. 8A-8C in accordance with aspects of the present invention.
Figure 10B:
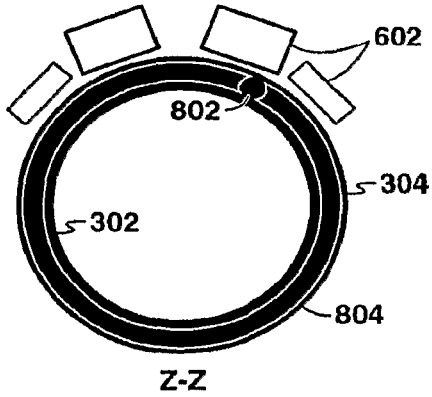
Figure 10C:
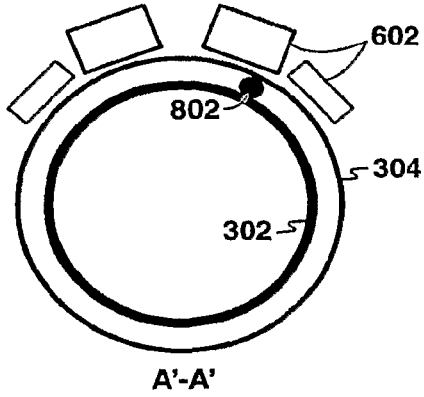

As another example, FIGS. 10A-10C are illustrative views of a second alternative embodiment of sand control device of FIGS. 8A-8C in accordance with aspects of the present invention. FIGS. 10A-10C show alternative views of a sand control device 1000 in different stages of operation, such as gravel packing and production, with the addition of external shunt tubes 602. Accordingly, the sand control device 1000 utilizes the reference numerals for similar components to those described above in FIGS. 3A-3G, 6A-6G and 8A-8C. In this embodiment, the shunt tubes 602 have been included with the sand control device 1000 to provide a mechanism for gravel packing other portions of the wellbore through the sand control device 1000, as described below. Again, the shunt tubes 602 may include packing tubes and/or transport tubes to gravel pack the sand control device 1000 within the wellbore.

In FIGS. 10A-10C, the sand control device 1000 includes openings 310, shunt tubes 602, conduit 802 and barrier element 804. The barrier element 804 is positioned between the base pipe 302 and the sand screen 304 to isolate the chambers in the main body section 810 and the perforated section 812 from each other. Accordingly, in this embodiment, the barrier element 804 may be a single element with openings for the conduit 802. Fluid from the interval may flow along the path 1002 for gravel packing and production operations. For an alternative perspective of the sand control device 1000, cross sectional views of some of the various components are shown along the line ZZ in FIG. 10B and along the line A'A' in FIG. 10C.

Sand Control Device with Sliding Sleeve

Figure 11A:
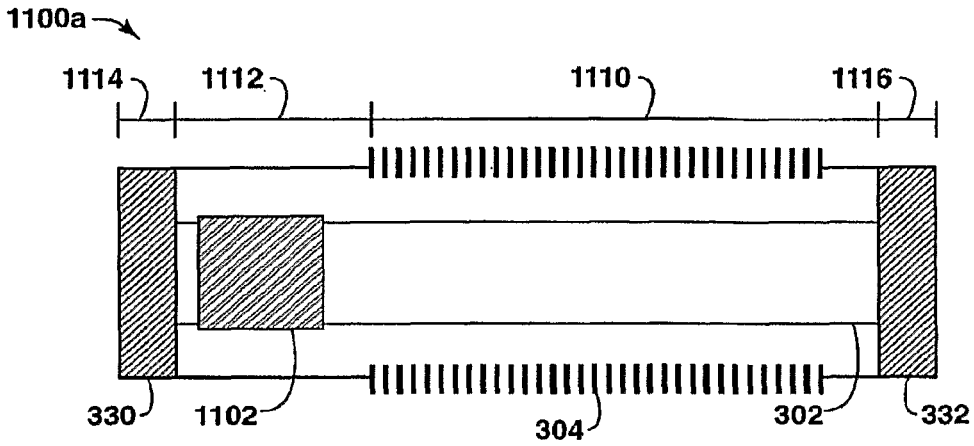
FIGS. 11A-11F are illustrative views of yet another alternative embodiment of a sand control device utilized in the production system of FIG. 1 with an inflow control mechanism having a sleeve in accordance with aspects of the present invention.
Figure 11B:
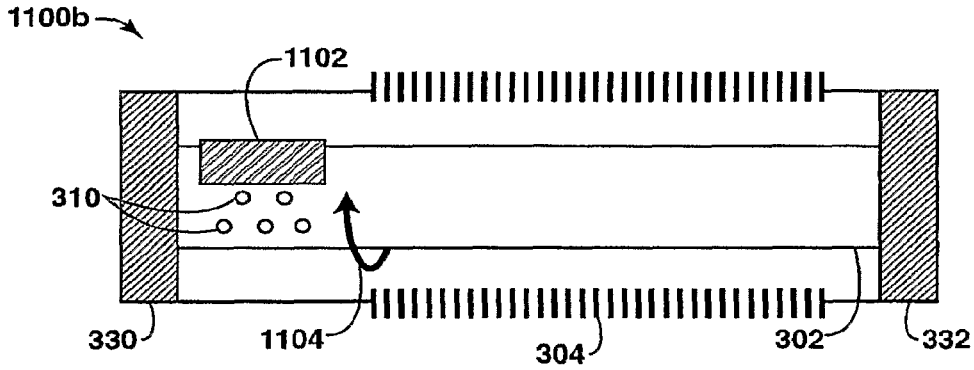
Figure 11C:
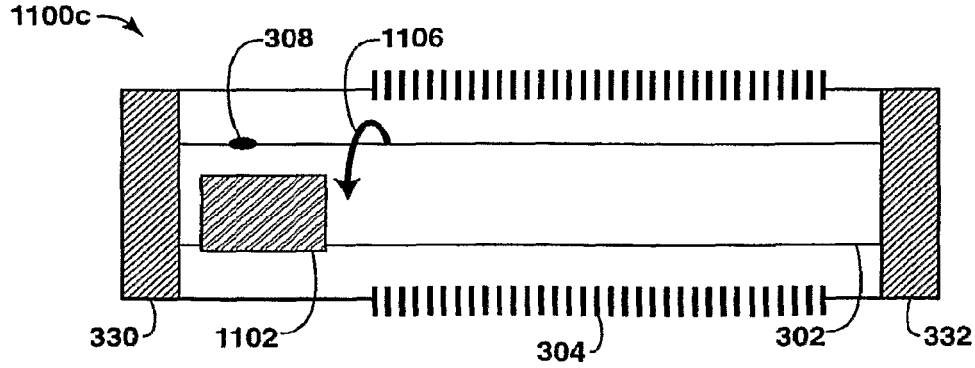
Figure 11D:
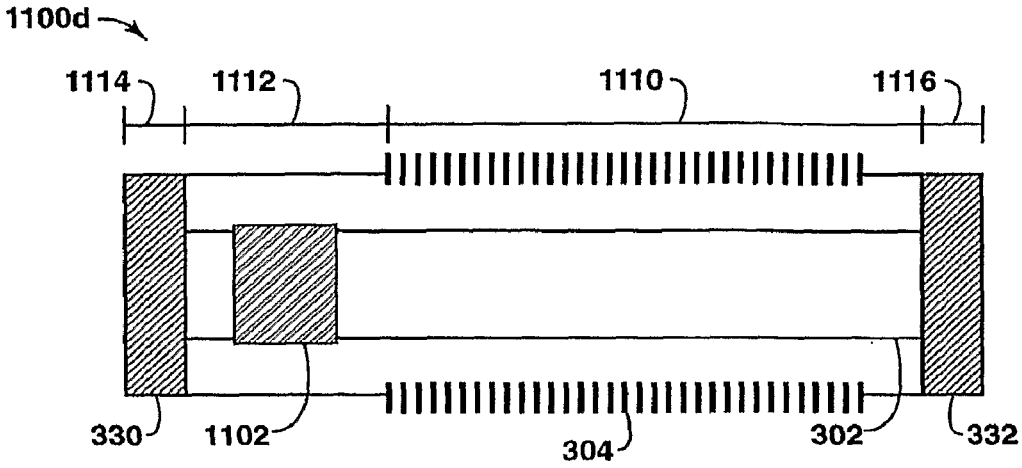
Figure 11E:
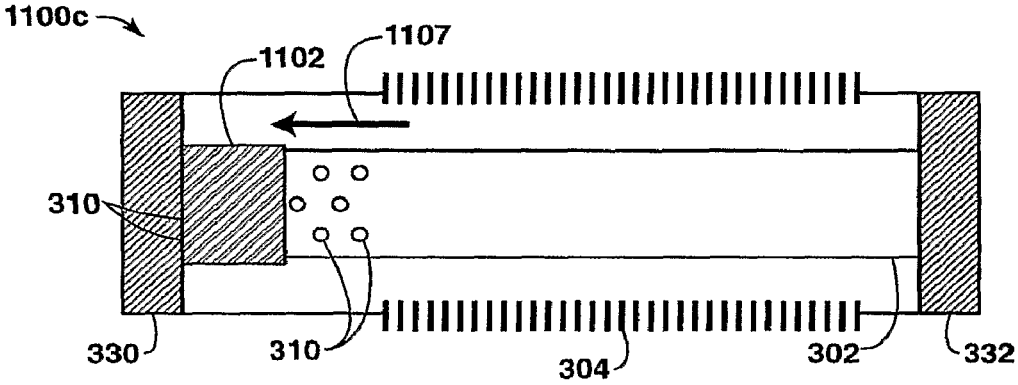
Figure 11F:
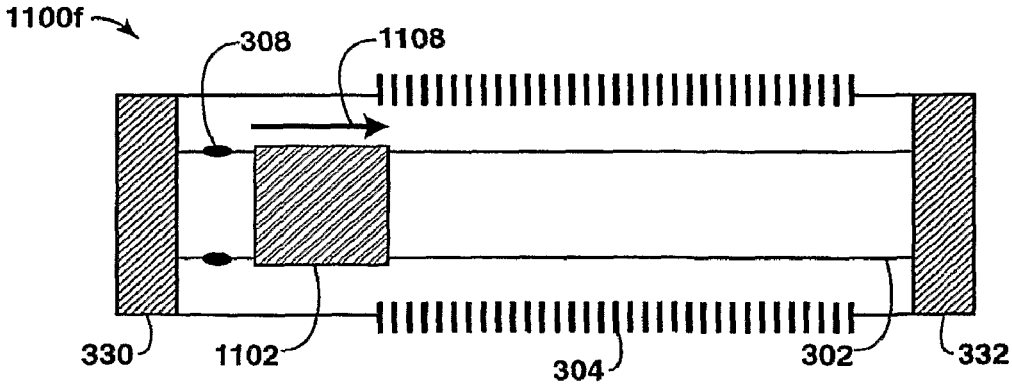

FIGS. 11A-11F are illustrative views of yet another alternative embodiment of a sand control device utilized in the production system of FIG. 1 with an inflow control mechanism having a sleeve in accordance with aspects of the present invention. FIGS. 11A-11F show alternative views of the sand control devices 1100*a*-1100*f* in different stages of operation, utilizing the reference numerals for similar components to those described above in FIGS. 3A-3G. However, in this embodiment, a sleeve 1102, which may be adjusted into a plurality of positions, such as a running position, gravel packing position, and production position, is utilized to control flow paths through the sand control devices 1100*a*-1100*f*, which may collectively be referred to as sand control device 1100. For example, the sleeve 1102 in FIGS. 11A-11C is configured to rotate around the circumference of the base pipe 302 in the directions indicated by the arrows 1104 and 1106, while the sleeve 1102 in FIGS. 11D-11F is configured to slide along the longitudinal axis of the base pipe 302 in the directions indicated by the arrows 1107 and 1108. Regardless of the specific sleeve configuration, the sleeve 1102 is adjustable to control the pressure loss for the different well operations and may be disposed externally or internally adjacent to the base pipe 302.

In one exemplary embodiment, the sand control device 1100 includes a main body section 1110, a perforation section 1112, a first connection section 1114 and a second connection section 1116, which are made of steel or metal alloys. Similar to the sections 320, 324 and 326 of FIGS. 3A-3G, the sections 1110, 1114 and section 1116 may made from similar material, include similar components and be configured in a similar manner, as noted above. The perforated section 1112 may be made of steel and/or metal alloys and configured to be between about 4 in and about 4 ft, having specific internal and outer diameters.

In some embodiments, the sand control device 1100 may further include an inflow control device 308, openings 310, and a sleeve 1102 that are used to manage the flow of fluids during running, gravel packing and production operations. The sleeve 1102 may include a body of steel or metal alloy having a sealing element secured to the body. While the sleeve 1102 is shown positioned externally around the base pipe 302, the sleeve 1102 may also be disposed internal to the base pipe 302 in other embodiments.

In some embodiments of the operation of the present invention, the sleeve 1102 is configured to move between different positions, such as a running position as shown in FIGS. 11A and 11D, a gravel packing position as shown in FIGS. 11B and 11E, and a production position as shown in FIGS. 11C and 11F. For example, as shown in FIGS. 11A and 11D, the sleeve 1102 may be biased into the running position by a biasing member (not shown). In the running position, the sleeve 1102 may block fluid flow into the inflow control device 308 and the openings 310 by forming a seal that covers these components. Then, the sleeve 1102 may be moved into the gravel packing position by moving a washpipe through the sand control device 1100*a*. The movement of the washpipe may break or disengage the biasing member. In the gravel packing position, the sleeve 1102 may block fluid flow into the inflow control device 308, but provide a fluid path through the openings 310, as shown in FIGS. 11B and 11E. In this manner, the carrier fluid may return from the wellbore through the sand screen 304 and into the openings 310. Once the gravel pack is formed, the washpipe may be removed from the sand control device 1100*b*. The removal of the washpipe may move the sleeve 1102 into the production position, as shown in FIGS. 11C and 11F. In the production position, the sleeve 1102 may block fluid flow into the openings 310, but provide a fluid path through the inflow control device 308. In this manner, the formation fluid, such as hydrocarbons, may flow from the wellbore through the sand screen 304 and inflow control device 310 into the base pipe 302. It should be noted that the sleeve 1102, which may be controlled electrically or hydraulically as well, may be moved into the running position to block flow from the interval if water production is detected.

Beneficially, the sleeve 1102 having multiple positions may be utilized to manage the flow of fluids from the wellbore in an efficient manner. The sleeve 1102 provides additional flexibility for production operations and may reduce potential workovers by isolating the interval or portion of the interval adjacent to the sand control device 1100. However, note that the rotation of the sleeve may also include helical or other radial movement or rotation in other configurations.

As noted, the problems with the water/gas production may include productivity loss, equipment damage, and/or increased treating, handling and disposal costs. These problems are further compounded for wells having a number of different completion intervals, such as intervals 108*a*-108n, and where the formation strength may vary from interval to interval. As such, water or gas breakthrough in any one of the intervals may threaten the remaining reserves within the well. Accordingly, to provide the zonal isolation or manage the flow of fluids within the wellbore 114, packers may be utilized with the sand control devices 138*a*-138n, which may include one or more of the embodiments 300, 400, 500, 600, 700 and 1100, as discussed below in FIG. 12.

Figure 12:
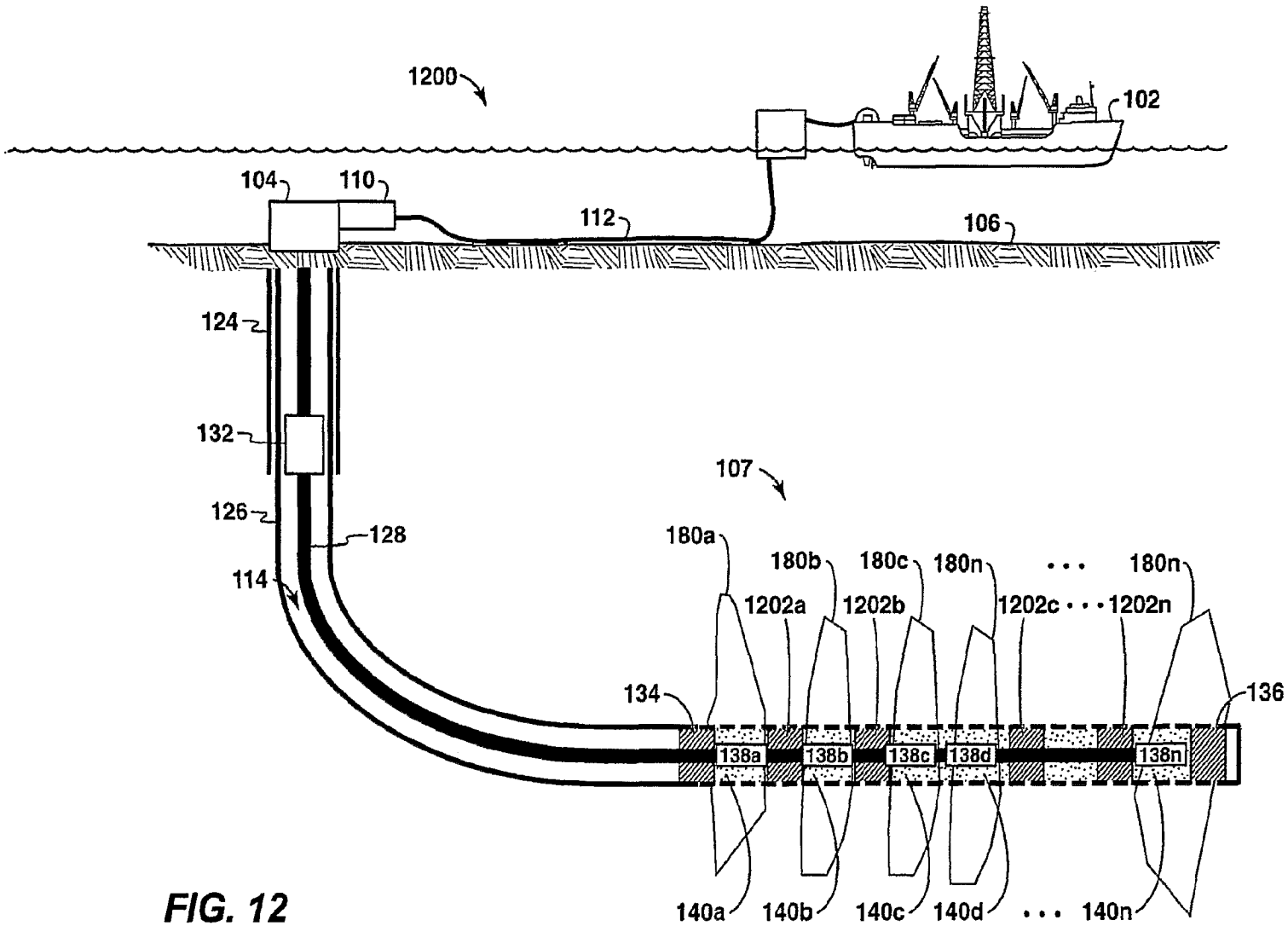
FIG. 12 is an alternative exemplary production system in accordance with aspects of the present invention.

FIG. 12 is an alternative exemplary production system 1200 in accordance with certain aspects of the present invention. The exemplary production system 1200 utilizes the reference numerals for similar components to those described above in FIG. 1. However, packers 1202*a*-1202n, wherein number "n" is any integer number, are utilized in this embodiment to isolate various intervals 108*a*-108n of the wellbore 114 from each other. The packers 1202*a*-1202n may include any suitable packers, such as the packers described in U.S. Provisional Application 60/765,023. Accordingly, in this embodiment, the various embodiments of sand control devices 138 along with the packers 1202*a*-1202n may be utilized to manage the flow of hydrocarbons or provide zonal isolation within the well.

As an example, to manage the flow of hydrocarbons, the sand control devices 138*a*-138n may include one or more of the embodiments 300, 400, 500, 600, 700 and 1100. If the sand control device 138 includes a water-swellable material as the sealing element 312 or has a sleeve 1102, the openings 310 may be utilized for gravel packing and production operations to maximize the production flow until water is produced from the interval. Once water is produced, the sealing element 312 may expand or the sleeve may be adjusted to the production position to seal the openings 310 from the formation fluid. As a result, the inflow control devices 308 are the only path from the interval to the interior of the base pipe 302. Beneficially, this embodiment may limit the impact of water production from one of the intervals of the formation.

To provide zonal isolation within the wellbore 114, the packers 1202*a*-1202n may be utilized with the sand control devices 138*a*-138n, which may include at least the embodiment 1100. In this example, the sand control device 138 may include a sleeve 1102 configured to provide or block access to the inflow control device 308 and openings 310. The openings 310 may be utilized for gravel packing, while the inflow control device 308 may be utilized for production operations. Once water is produced, the sleeve 1102 may be moved to the running position to seal the openings 310 and inflow control device 308 from the water. As a result, at least one sand control device 138 and two adjacent packers 1202*a*-1202n may be utilized to seal an interval within the wellbore 114. Alternatively, a water-swellable packer can be used for the same function when combined with any of the embodiments.

As alternative embodiments, different geometric patterns or any numbers of tubes, such as shunt tubes 402 and 602 and conduit 802, may be utilized for different applications. These tubes may be configured to provide redundancy flow paths or baffling (staggering) within the sand control devices 138. For example, while the sand control device 400 is shown with nine internal shunt tubes 402, sand control devices may include any number of shunt tubes, such as a one, two, three, four, five, six, seven, eight or more depending on the specific application. Also, while the sand control device 600 is shown with four external shunt tubes 602, sand control devices may include any number of shunt tubes, such as a one, two, three, four or more depending again on the specific application. Further, while the sand control device 800 is shown with one conduit 802, sand control devices may include any number of conduits, such as a one, two, three, four or more depending again on the specific application. In addition, it should again be noted that the tubes may include a variety of shapes and may be selected based upon on space limitations, pressure loss, and burst/collapse capacity. For instance, the tubes may be circular, rectangular, trapezoidal, polygons, or other shapes for different applications.

Similarly, the tubular members, such as base pipe 302 and sand screen 304, may include different geometric patterns, as discussed with the tubes, for different applications. For instance, the tubular member may include shapes, such as circular, rectangular, trapezoidal, polygons, or other shapes for different application. Also, while these tubular members are shown in a concentric configuration, eccentric configurations may also be utilized depending on the specific applications.

Further, these embodiments may be utilized with gravel placement procedures (i.e. gravel packing operations), which are discussed in U.S. Patent Application No. 60/765,023. For instance, a wellbore may be drilled with a drilling fluid to access a subsurface formation. The drilling fluid may be conditioned, by shakers and other equipment to remove material above a certain size. Then, one or more sand control devices may be positioned within or run into a wellbore adjacent to a subsurface formation in the conditioned drilling mud. The sand control devices may be any of the embodiments of the present invention disclosed herein, and/or other configurations already known or unknown, or some combination thereof. The sand control device may include inflow control mechanism to provide pressure loss during gravel packing operations that are less than the pressure loss during some of the production operations. A crossover tool may be coupled to or engaged with the sand control device and a packer may be set above the sand control device to isolate the wellbore above the sand control device. Once set, the conditioned drilling fluid adjacent to the sand control device may be displaced with a carrier fluid. Then, the carrier fluid with gravel may be circulated through the cross over tool to form a gravel pack around the sand control device within the wellbore. Then, the crossover tool may be disengaged from the sand control device and a production tubing string may be coupled to the sand control device. Then, an adjustment may be made to the sand control device to limit the fluid flow during production operations, in the different approaches discussed above. Then, hydrocarbons may be produced through the gravel pack and sand control device.

It should be noted that the term "above," when used to describe the position of a device in a well should be construed broadly and not limited to mean "closer to the surface." As is known, some wells may be horizontal or even have a slight upward angle such that a device that is closer to the surface may be farther "down" the production string if the path of the well is taken. Here, "above" or "below," when used in the context of a production string arrangement refers to the path of the production string, not the straight line distance to the earth's surface.

While the present invention may be susceptible to various modifications and alternative forms, the exemplary embodiments discussed above have been shown only by way of example. However, it should again be understood that the invention is not intended to be limited to the particular embodiments disclosed herein. Indeed, the present invention includes all alternatives, modifications, and equivalents falling within the true spirit and scope of the appended claims.

What we claim is:

1. A system associated with the production of hydrocarbons comprising:

a wellbore utilized to produce hydrocarbons from a subsurface reservoir;

a production tubing string disposed within the wellbore;

at least one sand control device coupled to the production tubing string and disposed within the wellbore, wherein at least one of the at least one sand control device comprises:

a first tubular member having a permeable section and a non permeable section;

a second tubular member disposed within the first tubular member, wherein the second tubular member has a plurality of openings and at least one inflow control device that each provide a flow path to the interior of the second tubular member; and a sealing mechanism disposed between the first tubular member and the second tubular member, wherein the sealing mechanism is configured to provide pressure loss during gravel packing operations that is less than the pressure loss during at least a portion of production operations.

2. The system of claim 1 wherein pressure loss is change in fluid pressure as the fluid flows outside the at least one sand control device into the interior of the second tubular member.

3. The system of claim 1 wherein the at least one sand control device is disposed within an open-hole section of the wellbore.

4. The system of claim 1 further comprising at least one shunt tube secured to at least one of the first tubular member and the second tubular member.

5. The system of claim 4 wherein the at least one shunt tube comprises a plurality of shunt tubes and the sealing mechanism comprises a plurality of sections disposed between two of the plurality of shunt tubes.

6. The system of claim 5 further comprising at least one support member disposed around at least one of the plurality of shunt tubes and secured to at least one of the first tubular member and the second tubular member.

7. The apparatus of claim 4 further comprising at least one rib disposed between the first tubular member and the second tubular member to support the permeable section of the first tubular member.

8. The system of claim 1 wherein the sealing mechanism is a swellable material that automatically responds to the presence of a stimulus.

9. The system of claim 1 wherein the sealing mechanism is one of hydraulically actuated, electrically actuated, and chemically actuated.

10. The system of claim 1 wherein the sealing mechanism is disposed between the plurality of openings and the at least one inflow control device, wherein the sealing mechanism is configured to:

provide a first flow path to the interior of the second tubular member from the permeable section of the first tubular member through the plurality of openings and the at least one inflow control device, and a second flow path to the interior of the second tubular member from the permeable section of the first tubular member through the at least one inflow control device during the gravel packing operations; and block fluid flow through the first flow path during the at least a portion of the production operations.

11. The system of claim 10 wherein the plurality of openings and the at least one inflow control device are positioned on the same end of each of the at least one sand control device.

12. The system of claim 10 wherein the plurality of openings and the at least one inflow control device are positioned on opposite ends of each of the at least one sand control device.

13. The system of claim 10 wherein the at least one inflow control device comprises one of a nozzle, tortuous path, tube and any combination thereof.

14. The system of claim 1 wherein:

the sealing mechanism is configured to isolate a first chamber from a second chamber formed between the first tubular member and second tubular member, wherein the first chamber includes the permeable section of the first tubular member and the second chamber includes the plurality of openings in the second tubular member; and the at least one inflow control device is at least one conduit, wherein the at least one conduit provides at least one fluid flow path between the first chamber and the second chamber through the sealing mechanism.

15. The system of claim 1 wherein the sealing mechanism comprises a sleeve disposed adjacent to the second tubular member and configured to move between a plurality of positions, wherein the plurality of positions comprises:

a first position providing a first flow path into the interior of the second tubular member from the permeable section of the first tubular member through at least the plurality of openings; and a second position providing a second flow path into the interior of the second tubular member from the permeable section of the first tubular member through only the at least one inflow control device.

16. The system of claim 15 wherein the sleeve is configured to rotate partially around the second tubular member.

17. The system of claim 15 wherein the sleeve is configured to slide along the second tubular member.

18. The system of claim 1 further comprising a gravel pack formed around the at least one sand control device.

19. The system of claim 1 further comprising a tree coupled to the production tubing string and disposed above the wellbore and further comprising a floating production facility coupled to the tree and utilized to produce hydrocarbons from the subsurface reservoir.

20. The system of claim 1 wherein gravel packing operations comprise activities performed to form a gravel pack at least partially around the at least one sand control device.

21. The system of claim 1 wherein production operations comprise activities performed to produce hydrocarbons from the subsurface reservoir after an at least partial gravel pack is formed around the at least one sand control device.

22. A method of producing hydrocarbons from a well comprising:

disposing at least one sand control device within a wellbore adjacent to a subsurface formation, wherein at least one of the at least one sand control device comprises:

a first tubular member having a permeable section and a non permeable section;

a second tubular member disposed within the first tubular member, wherein the second tubular member has a plurality of openings and at least one inflow control device that each provide a flow path to the interior of the second tubular member; and a sealing mechanism disposed between the first tubular member and the second tubular member, wherein the sealing mechanism is configured to provide pressure loss during gravel packing operations that is less than the pressure loss during at least a portion of production operations;

gravel packing the at least one sand control device within the wellbore; and producing hydrocarbons from the at least one sand control device by passing hydrocarbons through the at least one sand control device.

23. The method of claim 22 further comprising adjusting the at least one of the at least one sand control device to limit fluid flow through the at least one inflow control device.

24. The method of claim 23 wherein adjusting the at least one of the at least one sand control device comprises an automatic response of a sealing element in the at least one sand control device to a stimulus.

25. The method of claim 23 wherein adjusting the at least one of the at least one sand control device comprises adjusting a sleeve in the at least one sand control device.

26. The method of claim 22 further comprising adjusting the at least one of the at least one sand control device to block at least one fluid flow path into the interior of the at least one sand control device.

27. The method of claim 22 comprising:

conditioning a drilling fluid utilized to access the subsurface formation via the wellbore, wherein the at least one of the at least one sand control device is disposed in the wellbore in the conditioned drilling fluid;

displacing the conditioned drilling fluid adjacent to the at least one of the at least one sand control device with a carrier fluid after setting a packer above the at least one of the at least one sand control device; and gravel packing the at least one of the at least one sand control device with the carrier fluid having gravel.

28. The method of claim 27 wherein the carrier fluid comprises a fluid viscosified with hydroxyethylcellulose (HEC) polymer.

29. The method of claim 27 wherein the carrier fluid comprises a fluid viscosified with one of xanthan polymer and visco-elastic surfactant.

30. The method of claim 27 wherein the carrier fluid has favorable rheology and sand carrying capacity for gravel packing the at least one of the at least one sand control device in the wellbore with alternate path technology in the at least one of the at least one sand control device.

31. The method of claim 27 further comprising setting a plurality of packers to provide zonal isolation in the well.

32. The method of claim 22 wherein pressure loss is change in fluid pressure as the fluid flows outside the at least one of the at least one sand control device into the interior of a tubular member within the at least one of the at least one sand control device.

33. A system associated with production of hydrocarbons comprising:

a production tubing string disposed within a wellbore utilized to access a subsurface formation;

at least one sand control device coupled to the production tubing string and disposed within the wellbore, wherein at least one of the at least one sand control device comprises:

a first tubular member having a permeable section and a non permeable section; and a second tubular member disposed within the first tubular member, wherein the second tubular member has a plurality of openings and at least one inflow control device; and a sealing mechanism disposed between the first tubular member and the second tubular member, wherein the sealing mechanism is configured to:

provide a first flow path into the interior of the second tubular member during a gravel packing operation through one of (i) only the plurality of openings and (ii) the plurality of openings and the at least one inflow control device; and provide a second flow path into the interior of the second tubular member during at least one production operation through only the at least one inflow control device.

34. The system of claim 33 wherein the at least one of the at least one sand control device is disposed within an open-hole section of the wellbore.

35. The system of claim 33 further comprising at least one shunt tube secured to at least one of the first tubular member and the second tubular member.

36. The system of claim 33 wherein the sealing mechanism is a swellable material that automatically expands to block fluid flow into the plurality of openings in response to the presence of a stimulus.

37. The system of claim 33 wherein the sealing mechanism is one of hydraulically actuated, electrically actuated, and chemically actuated.

38. The system of claim 33 wherein the sealing mechanism is disposed between the plurality of openings and the at least one inflow control device, wherein the sealing mechanism is configured to block fluid flow through the plurality of openings during the at least one production operation.

39. The system of claim 33 wherein the plurality of openings and the at least one inflow control device are positioned on the same end of each of the at least one of the at least one sand control device.

40. The system of claim 33 wherein the plurality of openings and the at least one inflow control device are positioned on opposite ends of each of the at least one of the at least one sand control device.

41. The system of claim 33 wherein the sealing mechanism is a sleeve disposed adjacent to the second tubular member and configured to move between a plurality of positions, wherein the plurality of positions comprises:

a first position providing the first flow path into the interior of the second tubular member from the permeable section of the first tubular member; and a second position providing the second flow path into the interior of the second tubular member from the permeable section of the first tubular member.

42. The system of claim 41 wherein the sleeve is configured to rotate partially around the second tubular member.

43. The system of claim 41 wherein the sleeve is configured to slide along the second tubular member.

44. The system of claim 33 further comprising a gravel pack formed around the at least one of the at least one sand control device.

45. The system of claim 33 further comprising a tree coupled to the production tubing string and disposed above the wellbore and further comprising a floating production facility coupled to the tree and utilized to produce hydrocarbons from the subsurface reservoir.

46. The system of claim 33 wherein gravel packing operations comprise activities performed to form a gravel pack at least partially around the at least one of the at least one sand control device.

47. The system of claim 33 wherein at least one production operation comprises an activity performed to produce hydrocarbons from the subsurface reservoir after an at least partial gravel pack is formed around the at least one of the at least one sand control device.

48. A method associated with production of hydrocarbons comprising:

providing a sand control device having a first tubular member with a permeable section and a non permeable section; a second tubular member disposed within the first tubular member, wherein the second tubular member has a plurality of openings and at least one inflow control device; and a sealing mechanism disposed between the first tubular member and the second tubular member, wherein the sealing mechanism is configured to provide a first flow path to the interior of the second tubular member during gravel packing operations through one of only the plurality of openings and the plurality of openings along with the at least one inflow control device; and provide a second flow path to the interior of the second tubular member during at least a portion of production operations through only the at least one inflow control device;

disposing the sand control device within a wellbore;

engaging the sand control device to a crossover tool to form a gravel pack at least partially around the sand control device;

disengaging the crossover tool from the sand control device; and coupling the sand control device to a production tubing string to produce hydrocarbons through the at least one inflow control device.

49. The method of claim 48 further comprising adjusting the sand control device to limit fluid flow through the at least one inflow control device prior to the production operations.

50. The method of claim 49 wherein adjusting the sand control device is based on an automatic response of the sealing mechanism in the sand control device.

51. The method of claim 49 wherein the sealing mechanism comprises a sleeve, and wherein adjusting the sand control device comprises adjusting the sleeve in the sand control device.

52. The method of claim 48 further comprising adjusting the sand control device to block the first flow path to the interior of the second tubular member.

53. The method of claim 48 comprising:

conditioning a drilling fluid utilized to access the subsurface formation via the wellbore, wherein the sand control device is disposed in the wellbore in the conditioned drilling fluid;

setting a packer above the sand control device;

displacing the conditioned drilling fluid adjacent to the sand control device with a carrier fluid; and gravel packing the sand control device with the carrier fluid having gravel.

54. The method of claim 53 wherein the carrier fluid comprises a fluid viscosified with one of hydroxyethylcellulose (HEC) polymer, xanthan polymer, and visco-elastic surfactant.

55. The method of claim 53 wherein the carrier fluid has favorable rheology and sand carrying capacity for gravel packing the subsurface formation of the wellbore using the at least one sand control device with alternate path technology.

56. The method of claim 48 comprising injecting a treatment fluid into the sand control device to remove the sealing mechanism and enable fluid flow through the first flow path to the interior of the second tubular member.

57. An apparatus for producing hydrocarbons comprising:

a first tubular member having a permeable section and a non permeable section;

a second tubular member disposed within the first tubular member, wherein the second tubular member has a plurality of openings and at least one inflow control device; and a sealing element disposed between the first tubular member and the second tubular member and disposed between the plurality of openings and at least one inflow control device, wherein the sealing element is configured to:

provide a first flow path into the interior of the second tubular member from the permeable section of the first tubular member through the plurality of openings and a second flow path into the interior of the second tubular member from the permeable section of the first tubular member through the at least one inflow control device during a first operation;

block fluid flow through the first flow path while maintaining fluid flow through the second flow path during a second operation; and provide pressure loss during said first operation that is less than the pressure loss during at least a portion of said second operation.

58. The apparatus of claim 57 wherein the first tubular member comprises a sand screen and the permeable section comprises a filter medium.

59. The apparatus of claim 58 wherein the filter medium is one of mesh screen, wire wrapping, a medium to prevent a predetermined particle size and any combination thereof.

60. The apparatus of claim 57 wherein the second tubular member comprises a base pipe.

61. The apparatus of claim 57 further comprising at least one shunt tube secured to at least one of the first tubular member and the second tubular member.

62. The apparatus of claim 61 wherein the at least one shunt tube is disposed between the first tubular member and the second tubular member.

63. The apparatus of claim 62 wherein the at least one shunt tube comprises a plurality of shunt tubes and the sealing element comprises a plurality of sections disposed between two of the plurality of shunt tubes.

64. The apparatus of claim 62 further comprising a support member disposed around the at least one shunt tube and secured to at least one of the first tubular member and the second tubular member.

65. The apparatus of claim 57 further comprising at least one rib disposed between the first tubular member and the second tubular member to support the permeable section of the first tubular member.

66. The apparatus of claim 57 wherein the plurality of openings and at least one inflow control device are positioned on the same end of the apparatus.

67. The apparatus of claim 57 wherein the plurality of openings and at least one inflow control device are positioned on opposite ends of the apparatus.

68. The apparatus of claim 57 wherein the at least one inflow control device comprises one of a nozzle, tortuous path, tube and any combination thereof.

69. The apparatus of claim 57 wherein the plurality of openings comprises perforations in the second tubular member.

70. The apparatus of claim 57 wherein the sealing element is a swellable material that automatically expands in the presence of a stimulus.

71. The apparatus of claim 70 wherein the stimulus is one of water, conditioned drilling fluid, a completion fluid, a production fluid or any combination thereof.

72. The apparatus of claim 57 wherein the sealing element is one of hydraulically, electrically, and chemically actuated to expand to block fluid flow through the first flow path during the second operation.

73. The apparatus of claim 57 wherein the first operation is a gravel packing operation.

74. The apparatus of claim 57 wherein the second operation is a production operation.

* * * * *